US011986087B1

(12) United States Patent
Eng et al.

(10) Patent No.: US 11,986,087 B1
(45) Date of Patent: May 21, 2024

(54) UTILITY TRAY

(71) Applicant: ILW LC, Sheridan, WY (US)

(72) Inventors: Christopher Eng, Newton, MA (US); Patrick Triato, Portland, OR (US)

(73) Assignee: ILW LC, Sheridan, WY (US)

( * ) Notice: Subject to any disclaimer, the term of this patent is extended or adjusted under 35 U.S.C. 154(b) by 0 days.

(21) Appl. No.: 18/213,110

(22) Filed: Jun. 22, 2023

Related U.S. Application Data

(60) Provisional application No. 63/469,751, filed on May 30, 2023.

(51) Int. Cl.
*A47B 23/00* (2006.01)

(52) U.S. Cl.
CPC ..... *A47B 23/001* (2013.01)

(58) Field of Classification Search
CPC ..... A47B 5/02; A47B 23/001
See application file for complete search history.

(56) References Cited

U.S. PATENT DOCUMENTS 4,575,149 A * 3/1986 Forestal ..... A47B 23/02 248/240.4
6,012,690 A * 1/2000 Cohen ..... A47G 7/044 248/214
11,311,103 B1 * 4/2022 Wilson ..... A47B 9/00
2006/0220501 A1 * 10/2006 Robertson ..... A47B 87/0276 312/107
2007/0101908 A1 * 5/2007 Makita ..... A47B 5/02 108/47

* cited by examiner

*Primary Examiner* — Matthew W Ing
(74) *Attorney, Agent, or Firm* — Elliott, Ostrander & Preston, P.C.

(57) ABSTRACT

A tray capable of being frictionally engaged to a support structure comprises a horizontally oriented planar base having an edge. A right-angle bracket has a horizontally oriented side. An edge of the horizontally oriented side of the right-angle bracket is coupled adjacent the edge of the base and extends in a direction parallel to a plane of the base. The right-angle bracket has a vertically oriented side coupled to the horizontally oriented side at a corner of the right-angle bracket and extending downward. A bracket is coupled to a bottom surface of the base and extends downward in the direction substantially normal to the base. This bracket is positioned opposite the right-angle bracket a horizontal distance sufficient to receive the support structure positioned therebetween. A screw comprising a handle at a first end of the screw and a shoe at a second end of the screw passes through a threaded hole in the bracket and extends toward the right-angle bracket. Moving the handle causes the shoe and the right-angle bracket to frictionally engage the support structure positioned therebetween.

10 Claims, 65 Drawing Sheets

SECTION E-E

SECTION E-E

UTILITY TRAY

CROSS-REFERENCE TO RELATED APPLICATION

This application claims the benefit of U.S. Provisional Application No. 63/469,751, filed May 30, 2023, the entire contents of which are hereby incorporated by reference herein.

TECHNICAL FIELD

Embodiments of the present invention relate to utility trays, and in particular a tray that can be attached to a support member.

BACKGROUND

Utility trays have previously been provided with attachment means for attachment of the utility tray to a supporting structure. However, the attachment means do not work well for some support structures, for example, a bed frame.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

DETAILED DESCRIPTION

Figure 1A:
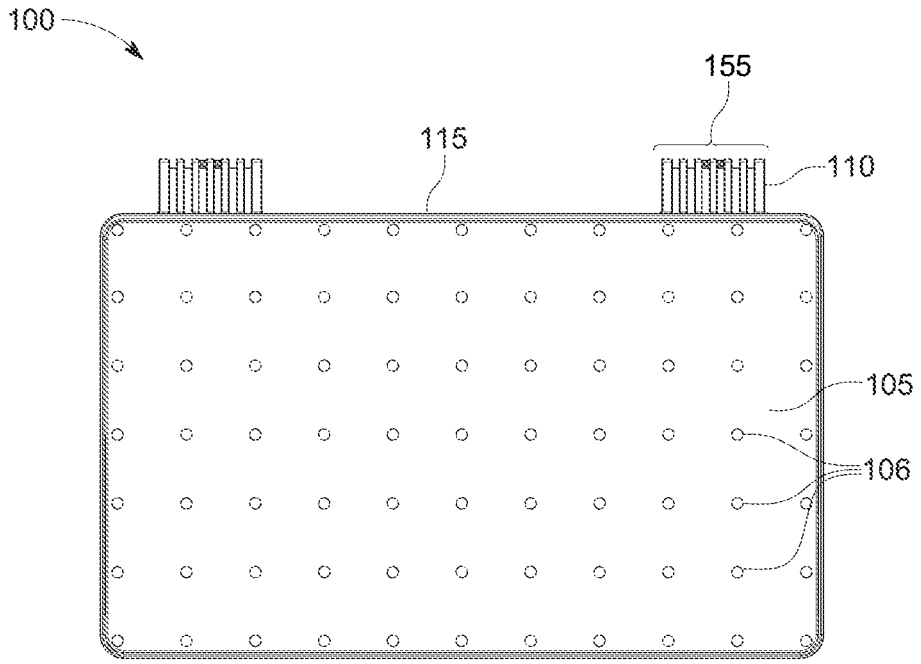
FIGS. 1A, 1B, 1C, 1D, 1E and 1F illustrate a utility tray according to an embodiment of the invention.
Figure 1B:
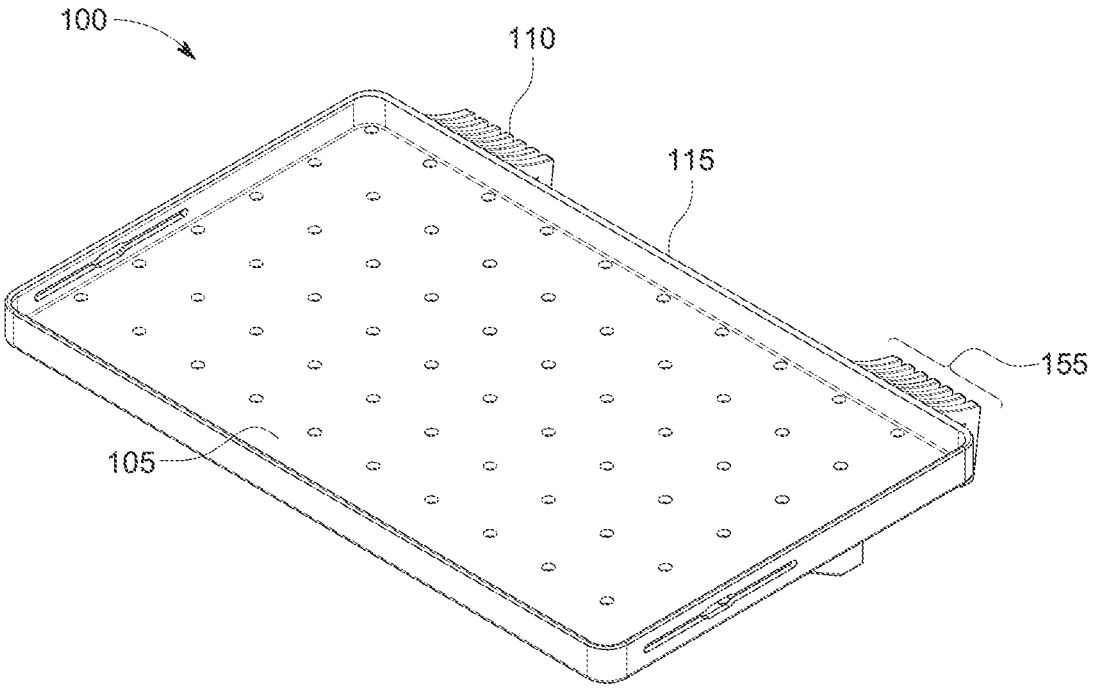
Figure 1C:
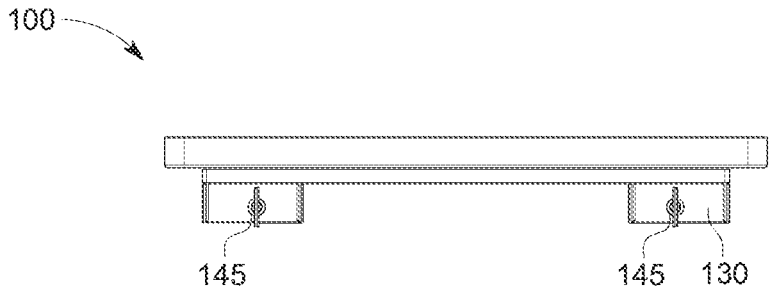
Figure 1D:
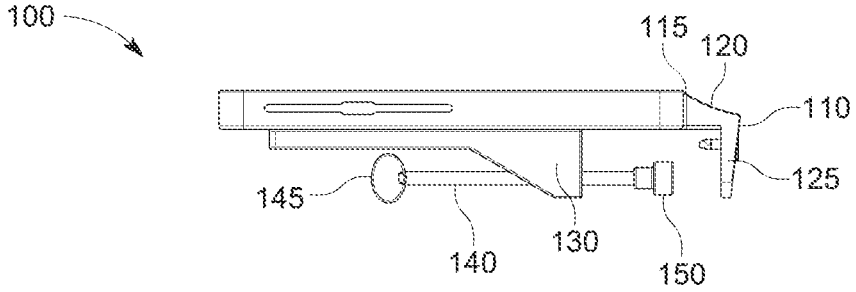
Figure 1E:
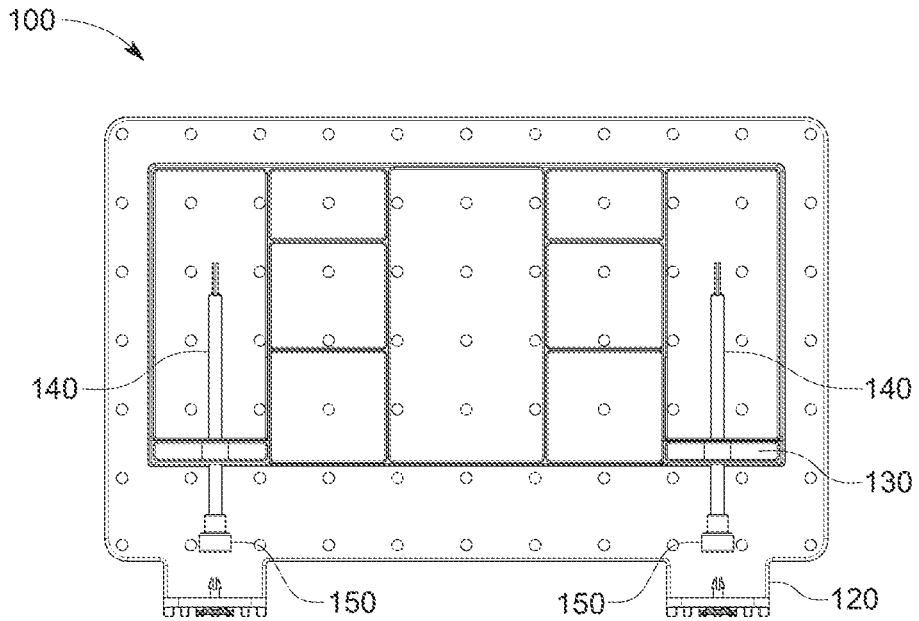
Figure 1F:
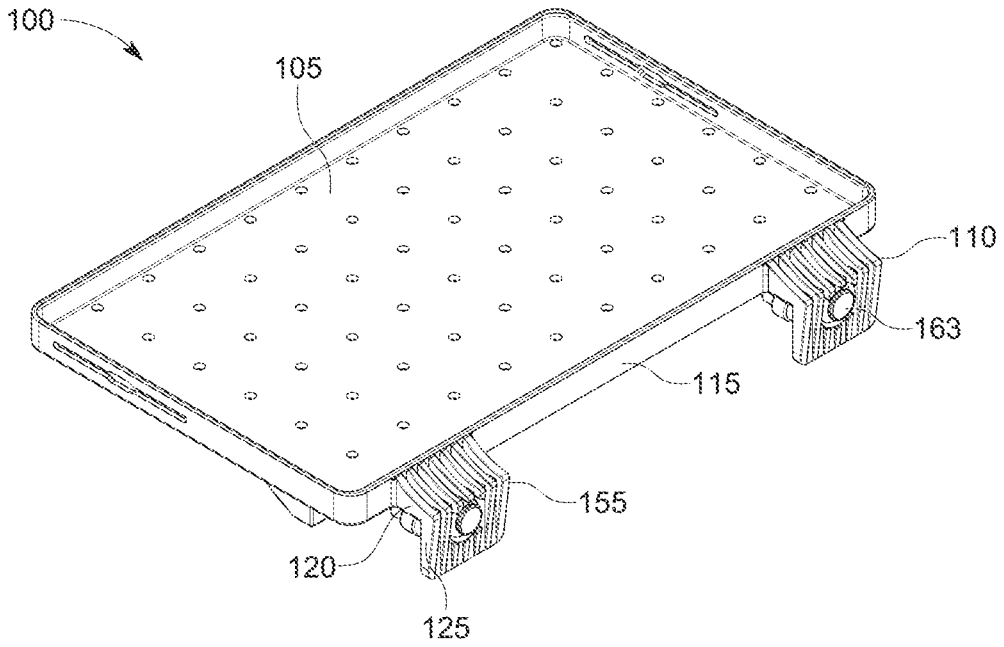
Figure 2:
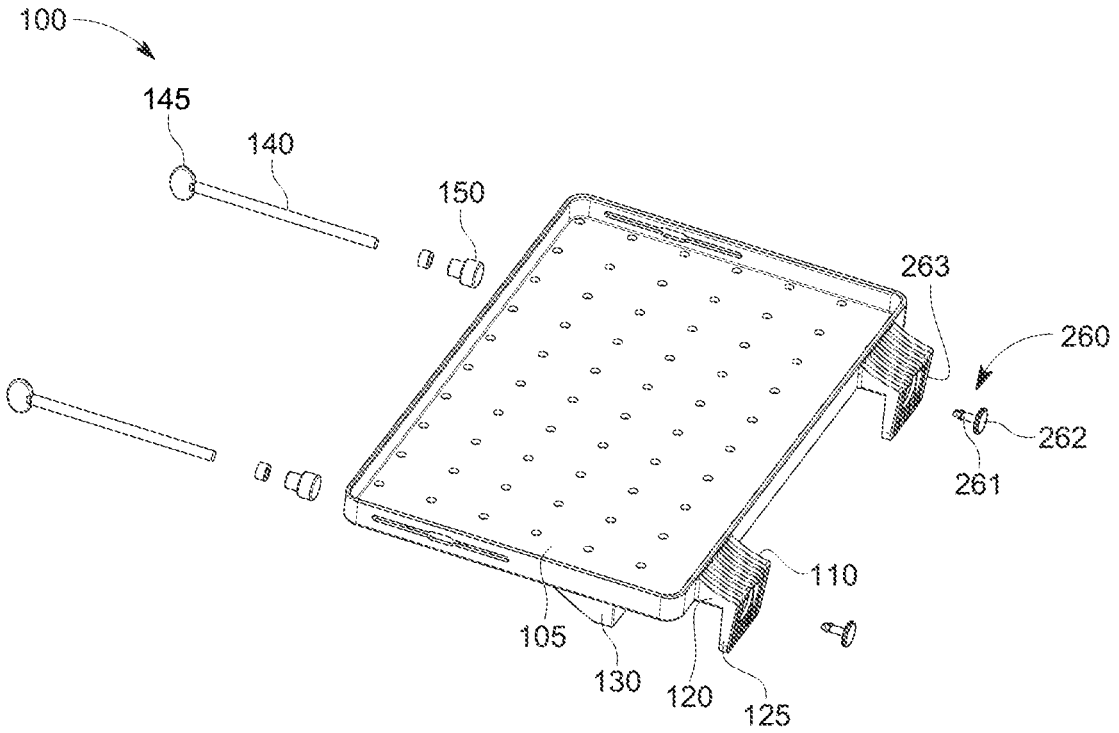
FIG. 2 illustrates a utility tray according to an embodiment of the invention.

FIGS. 1A-1F illustrate several views of a utility tray (100), according to an embodiment of the invention. The tray is capable of being frictionally engaged to, or clamped onto, a support structure, as disclosed in detail below. The support structure may have a rectangular cross section, as illustrated at 340 in FIG. 3B. Such a support structure may be made of solid wood, or hollow rectangular or square metal tubing. Alternatively, the support structure may be a right-angle structure, as illustrated at 440 in FIG. 4B, such as a piece of angle iron.

The tray may be made from wood product (such as bamboo or hardboard), metal, plastic, or a combination of such or other products. The tray includes a horizontally oriented planar base 105 (hereinafter "base 105"). The base has an edge 115 along which one or more brackets, such as right-angle brackets 110, may be molded or coupled. Although tray 100 is illustrated as having a rectangular-shaped planar base 105, it is appreciated that the tray base could be any shape such a polygon, circle, or oval shape. Although tray 100 is illustrated having two right-angle brackets, the lengths of which are relatively short compared to the length of edge 115, it is appreciated that a single bracket or multiple brackets may extend along much or all of the length of edge 115.

The right-angle bracket 110 has a horizontally oriented side 120. An edge of horizontally oriented side 120 is coupled to adjacent edge 115 of base 105. The horizontally oriented side 120 extends away from base 105 in a direction parallel to a plane of the base. The right-angle bracket 110 further has a vertically oriented side 125 coupled to horizontally oriented side 120 at a corner of the right-angle bracket and extending in a downward direction from the corner. In the illustrated embodiment, horizontally oriented side 120 of right-angle bracket 110 extends in the direction parallel in the same plane as base 105. In the embodiments, the horizontally oriented side may extend in the direction of a plane parallel to, and above the base, or a plane parallel to, and below the base.

According to one embodiment, right-angle bracket 110 comprises a ribbed surface 155 which provides strength and stiffness to the right-angle bracket. Alternatively, the horizontally and/or vertically oriented sides of the right-angle bracket could be made thicker to provide additional strength and stiffness, but at the expense of additional raw material and weight.

In one embodiment, ribbed surface 155 comprises spaced apart horizontally oriented ribs attached or molded to a top surface of horizontally oriented side 120 of right-angle bracket 110 and extending in a direction normal to the edge of the horizontally oriented side of the right-angle bracket. In one embodiment, the ribbed surface comprises spaced apart vertically oriented ribs attached to an outside surface of the vertically oriented side 125 of the right-angle bracket.

The tray 100 has another one or more brackets 130 coupled to a bottom surface of the base 105 and extending downward in the direction substantially normal to the base. Each bracket 130 is positioned opposite a right-angle bracket 110 with sufficient horizontal distance between the bracket and right-angle bracket to receive a support structure, such as support structure 340 or 440 illustrated in FIGS. 3B and 4B.

With reference to FIGS. 1A-1F, 2, 3B, 4B, 6C-6F, bracket 130 includes a threaded hole 335, 435, 635. A threaded fixing, for example, a bolt, or as illustrated in the figures, a screw 140 comprising a head or handle 145 at a first end of the screw and a shoe 150 at a second end of the screw is inserted through threaded hole 335, 435, 635 such that the second end of the screw passes through the threaded hole of bracket 130 and extends toward right-angle bracket 110. In alternative embodiments, the shoe may be a spinnable or movable turntable or shoe, wherein the turntable or shoe is affixed to the second end of the screw by a rivet of the like and can rotate about the long axis of the screw and/or pivot move angularly a limited amount with respect to a plane normal to the long axis of the screw, for example, to better accommodate clamping against a support structure. Turning the head or the handle 145 of screw 140 causes the shoe 150 to move toward to engage and trap the support structure between shoe 150 and right-angle bracket 110. As the head or handle is turned after the support structure is trapped between shoe 150 and right-angle bracket 110, the shoe and right-angle bracket frictionally engage the support structure positioned therebetween. In this manner, items (e.g., a laptop computer, a book, and various accessories, etc.) can be placed on and weigh down the tray and yet the tray is held firm in a substantially horizontal position to the support structure by virtue of shoe 150 and right-angle bracket 110 frictionally engaging the support structure.

The tray 100 illustrated in FIGS. 1A-1F includes a planar base 105 that is made of peg board. The peg board includes a one- or two-dimensional array of holes 106 that are distributed across at least a portion of base 105 to accommodate one or more accessories. Alternatively, the peg board may include one or more holes 106 that are strategically located to support the attachment of an accessory at a desired location. For example, one or more holes may be positioned only along the periphery or perimeter of base 105, or a portion thereof. Each accessory is designed to have a corresponding one or more pegs that can be inserted into a respective one or more holes in the peg board to firmly attach the accessory to tray 100. While the illustrated embodiment depicts round holes 106 in the planar base, it is appreciated that other shapes for holes may be used, including polygonal-shaped holes, oval-shaped holes, a slot-shaped hole, etc.

With reference to FIGS. 9A, 9B, 9C, 10A, 10B, 10C, 11A, 11B, 11C, 12A, 12B, 12C, 13A, 13B, 14A, 14B and 14C, several views of some of the following peg board accessories are illustrated: a vertical support post (for example, to support another tray or accessory positioned above base 105), a J-style hook, an S-style hook 900, a loop 1000, a bungee, a mobile computing device holder, a mobile phone holder 1100, a vertical dividing wall, a side or edge wall, a cup holder 1200, an LED light, a fan, a USB charging port, a DC electrical outlet, an electrical surge protector, a DC power strip, and a USB charging port device. The above examples are illustrative only; it is appreciated that many other accessories may also be similarly affixed to tray 100. As illustrated, each accessory comprises at least one peg 905 by which the accessory engages a hole in the peg board to firmly couple the accessory to the peg board. While the illustrated embodiment depicts round pegs that insert into a corresponding round hole 106 in the planar base, it is appreciated that other shapes for pegs that correspond to other shapes of holes may be used, including polygonal-shaped pegs, oval-shaped pegs, and blade or tab shaped pegs that insert into a slot-shaped hole, etc.

Figure 4A:
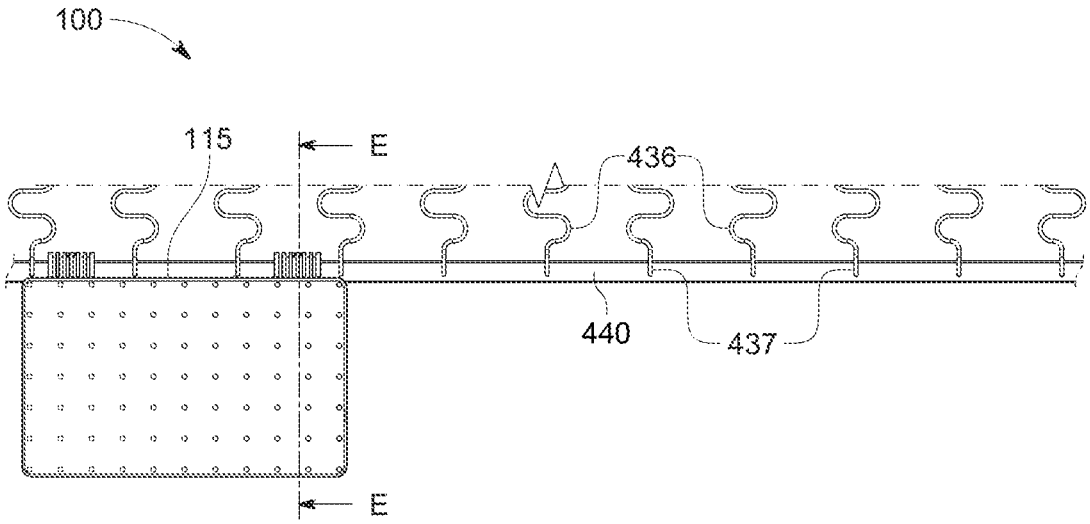
FIGS. 4A, 4B and 4C illustrate aspects of a utility tray according to an embodiment of the invention.
Figure 4B:
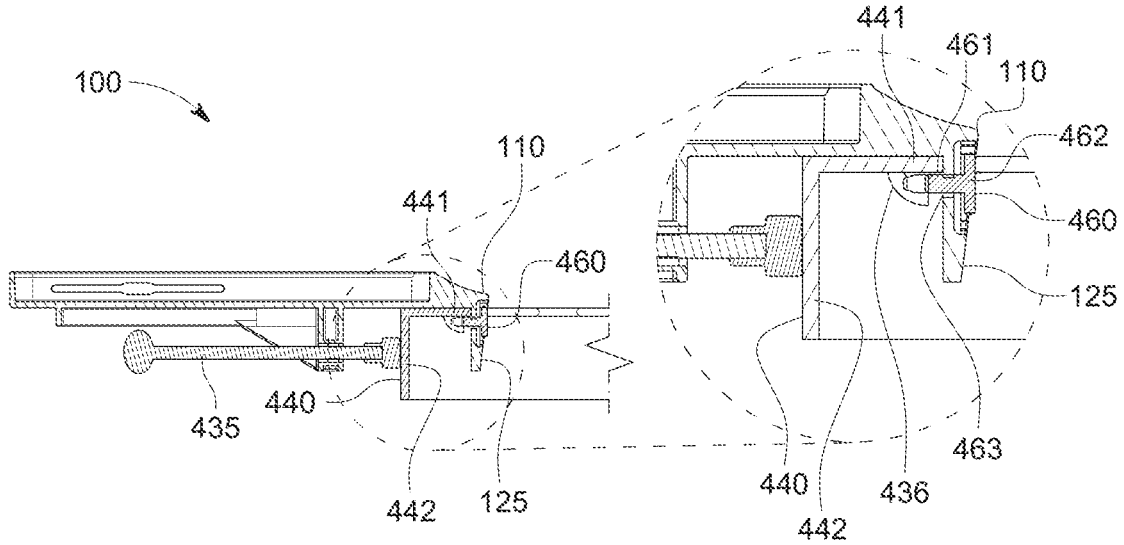
Figure 4C:
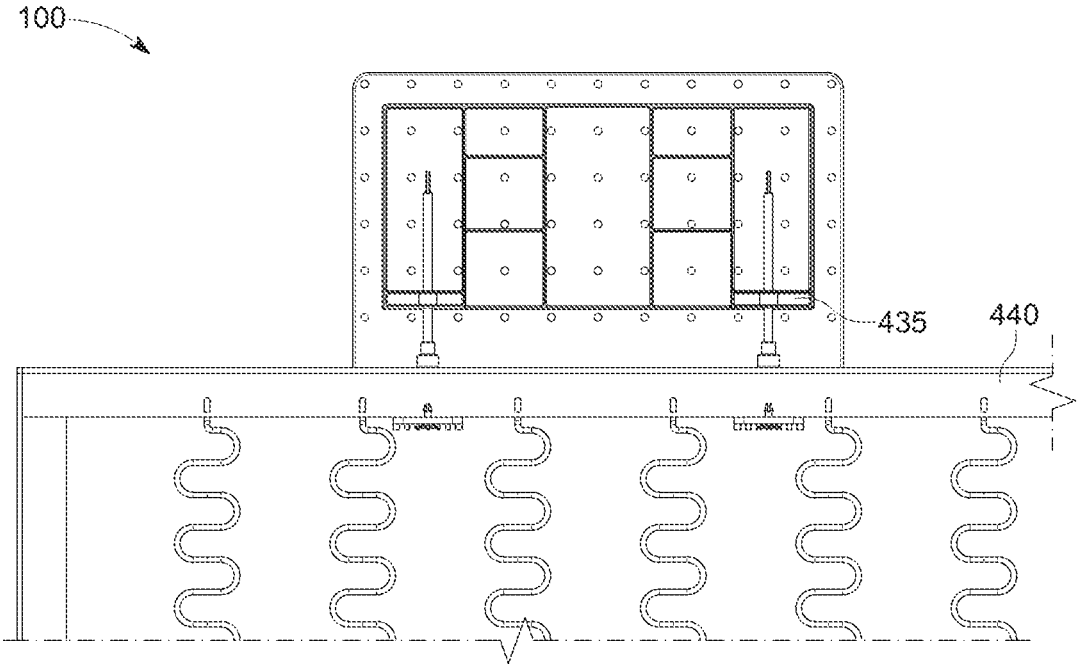
Figure 5A:
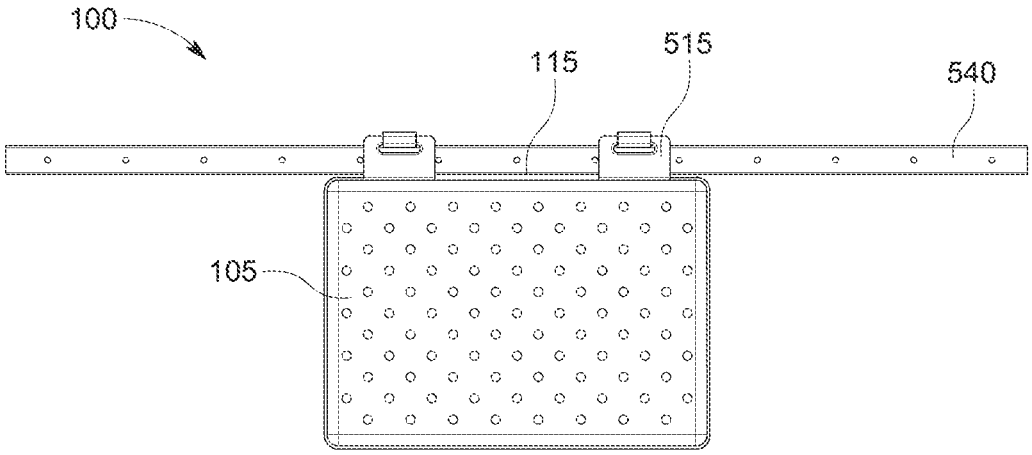
FIGS. 5A, 5B, 5C, 5D, 5E and 5F illustrate a utility tray according to an embodiment of the invention.
Figure 5B:
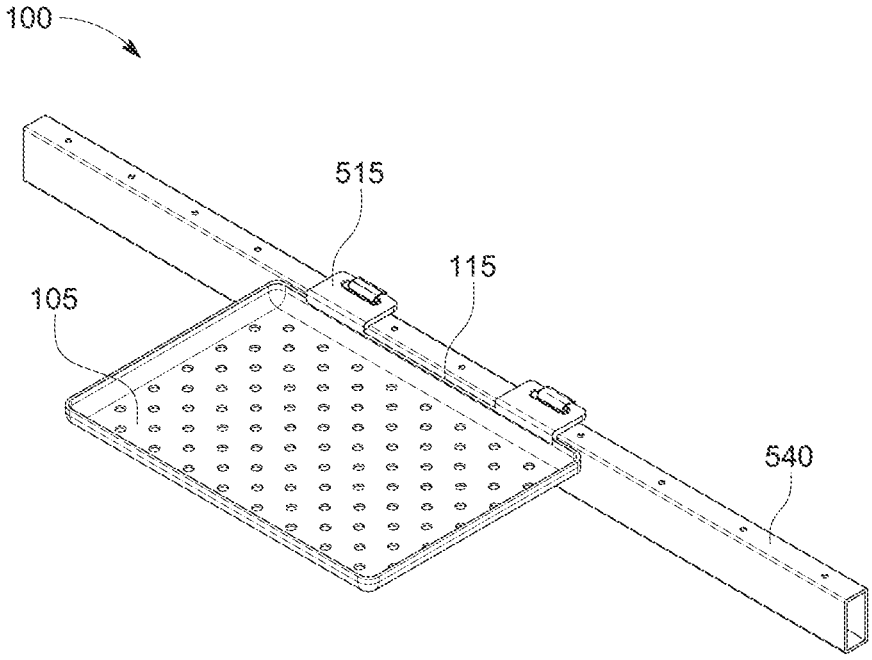
Figure 5C:
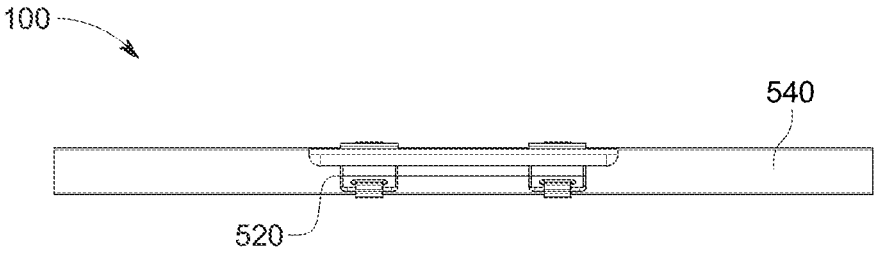
Figure 5D:
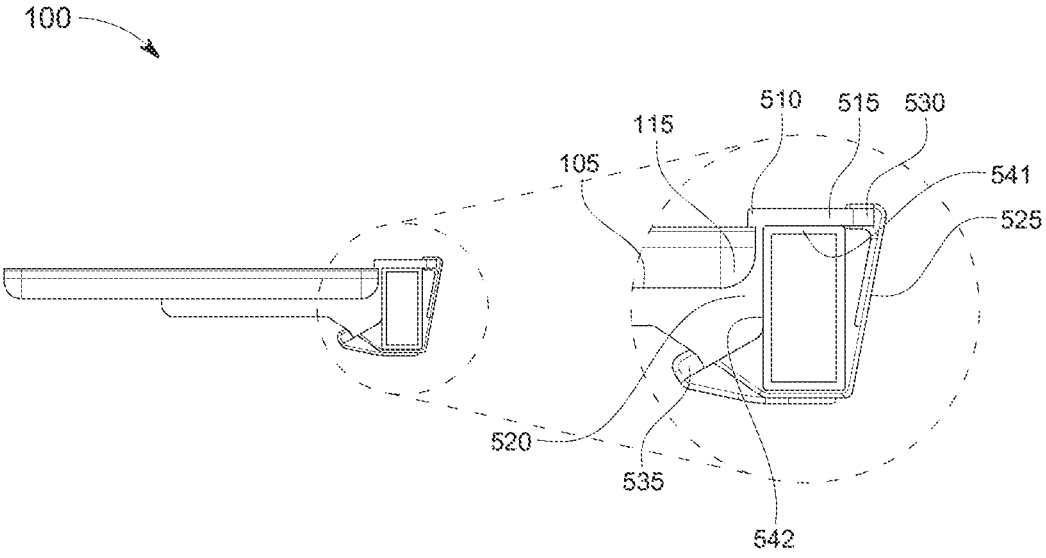
Figure 5E:
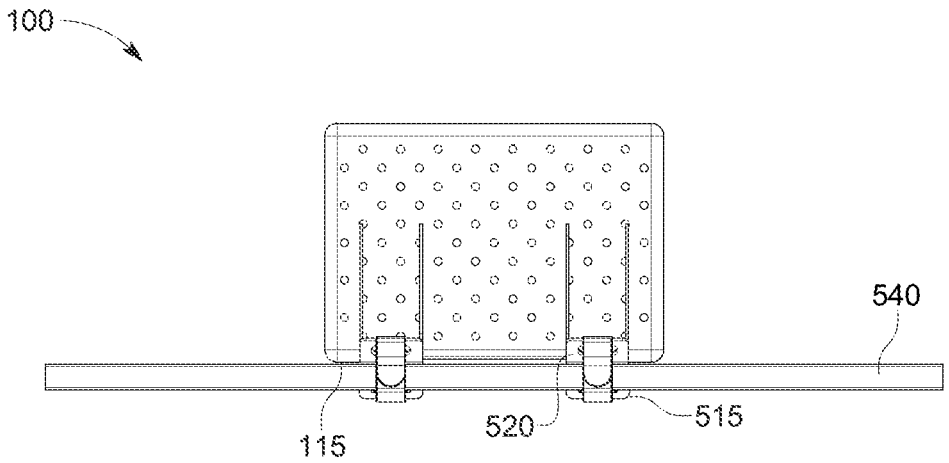
Figure 5F:
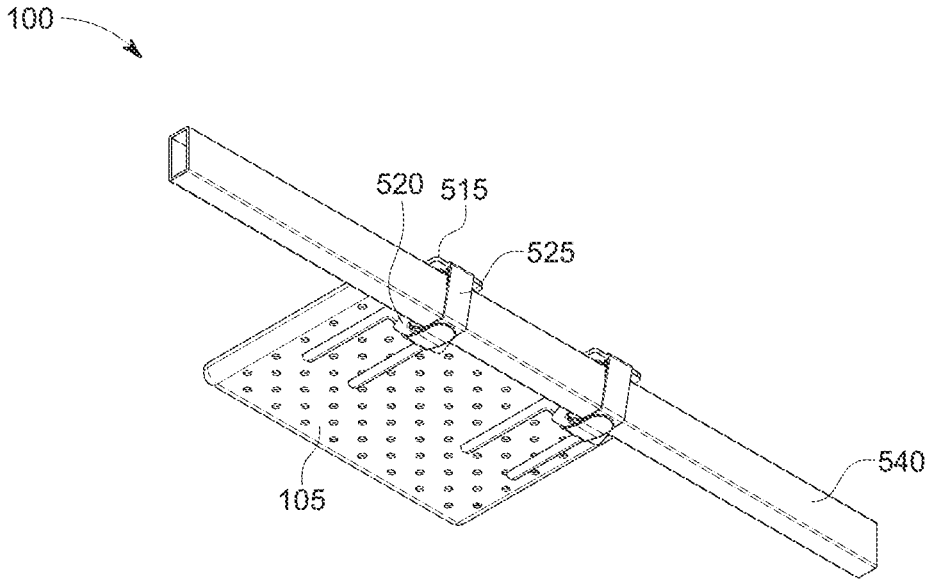
Figure 6A:
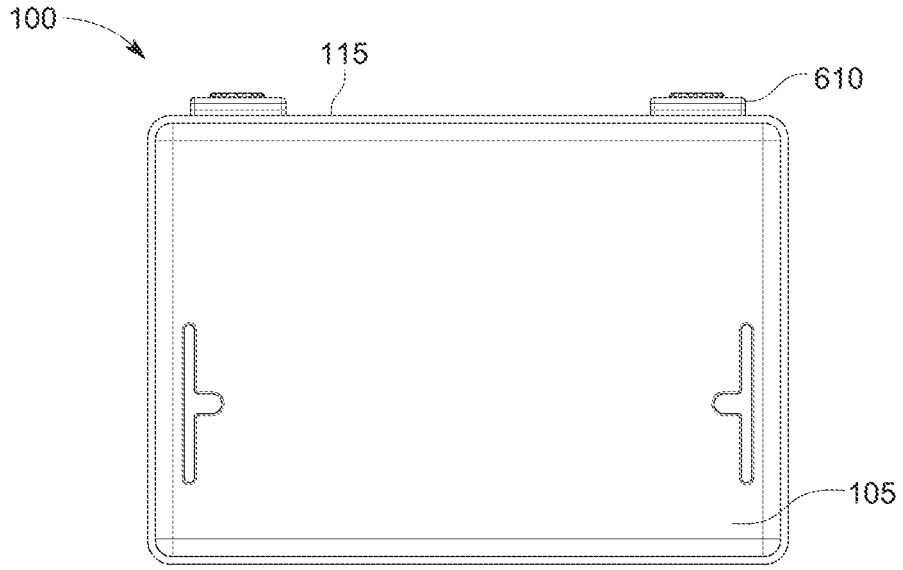
FIGS. 6A, 6B, 6C, 6D, 6E and 6F illustrate a utility tray according to an embodiment of the invention.
Figure 6B:
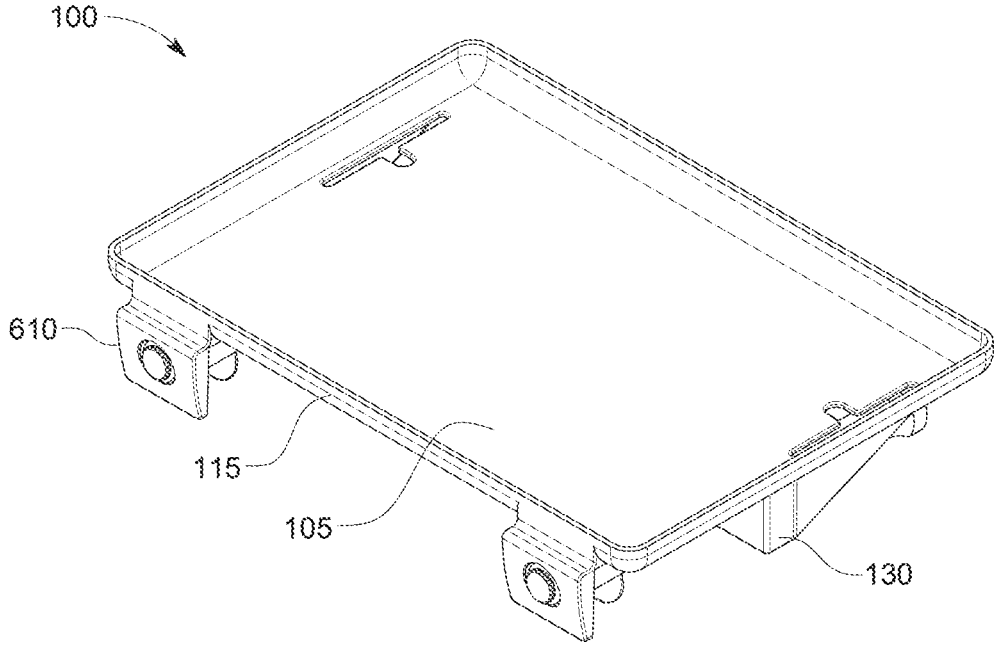
Figure 6C:
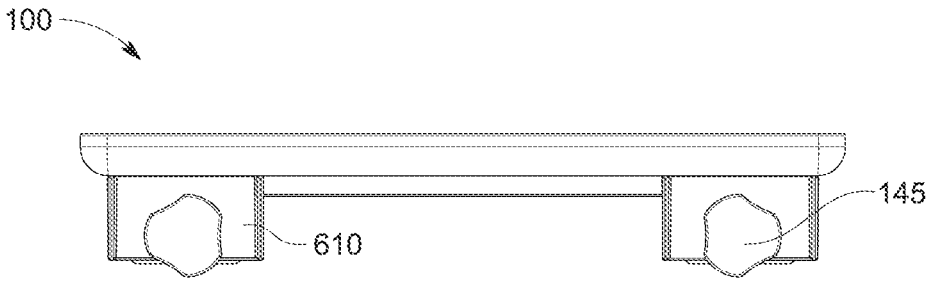
Figure 6D:
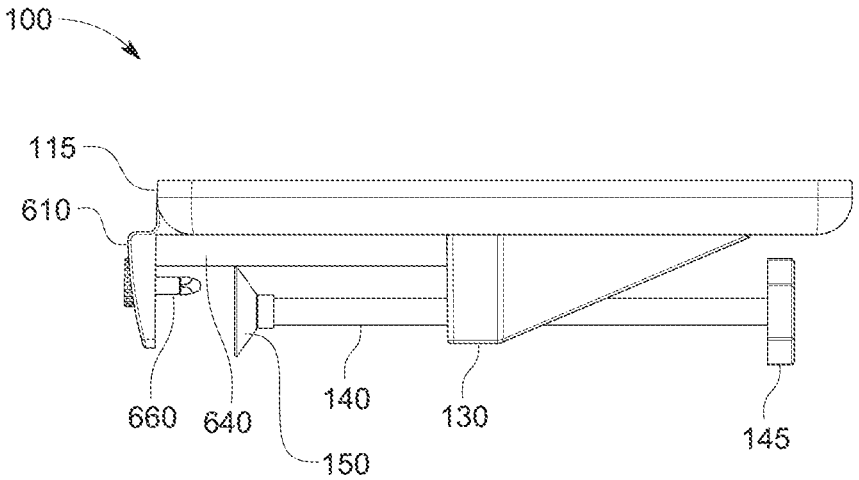
Figure 6E:
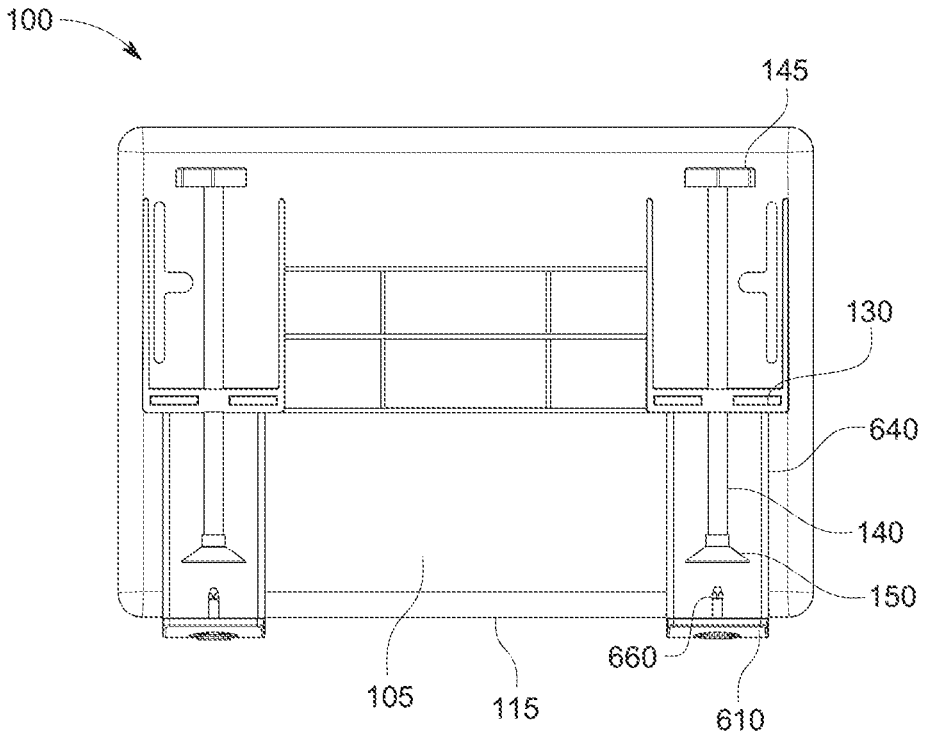
Figure 6F:
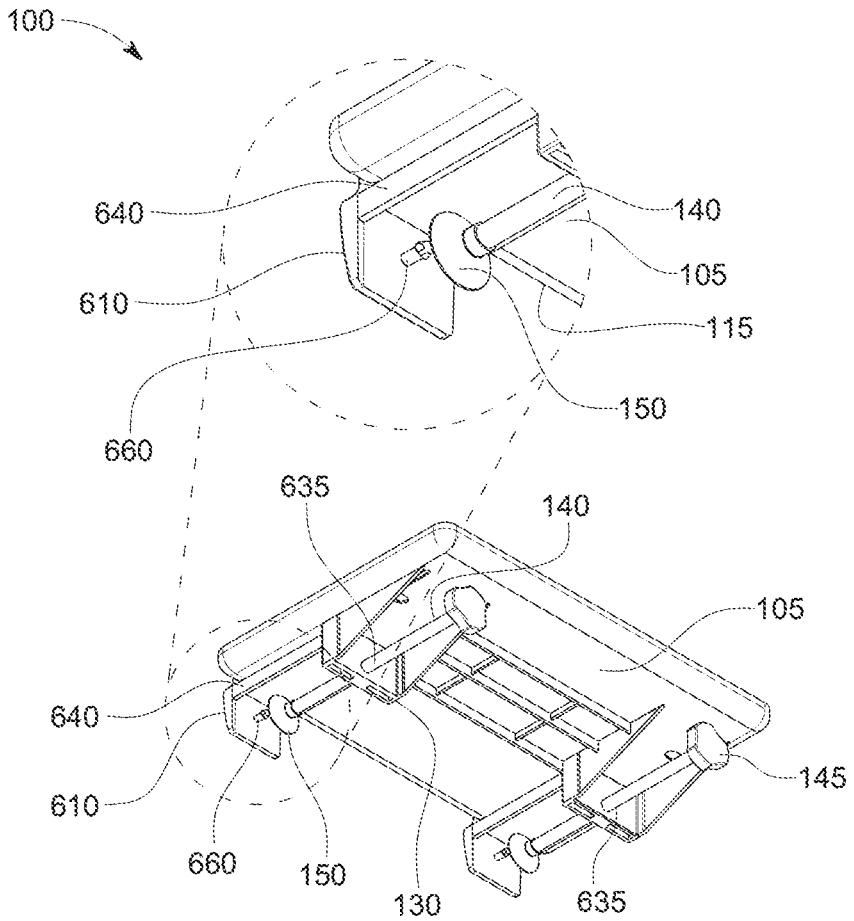
Figure 7A:
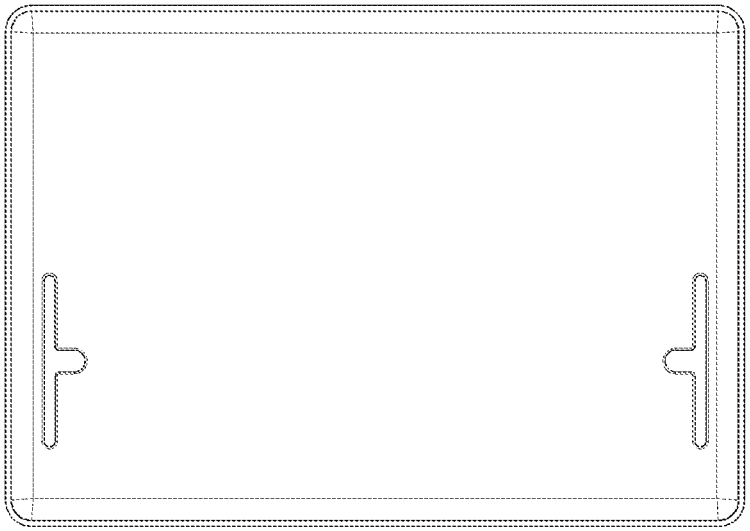
FIGS. 7A, 7B, 7C, 7D, 7E and 7F illustrate a utility tray according to an embodiment of the invention.
Figure 7B:
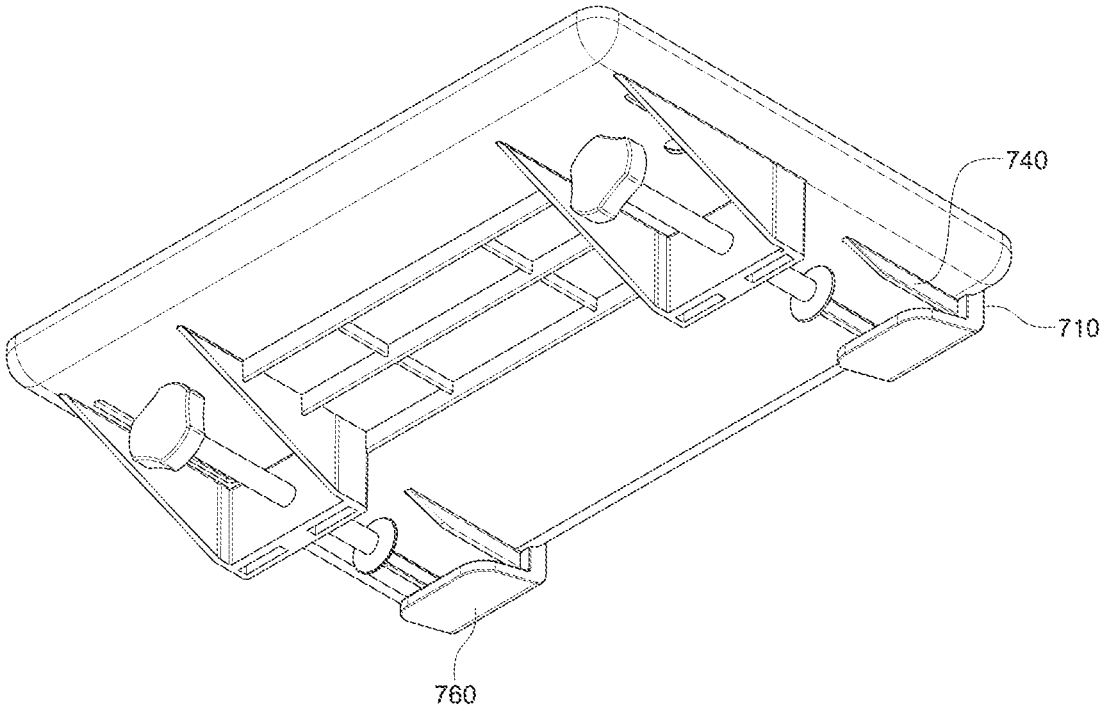
Figure 7C:
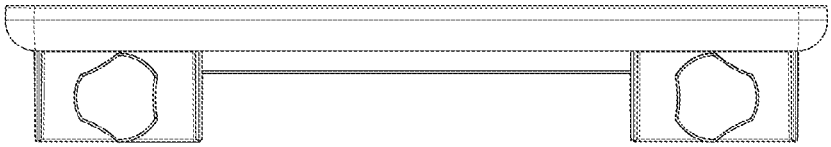
Figure 7D:
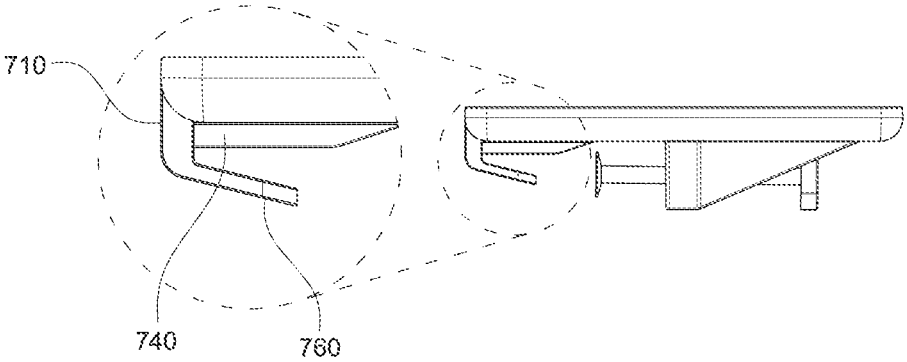
Figure 7E:
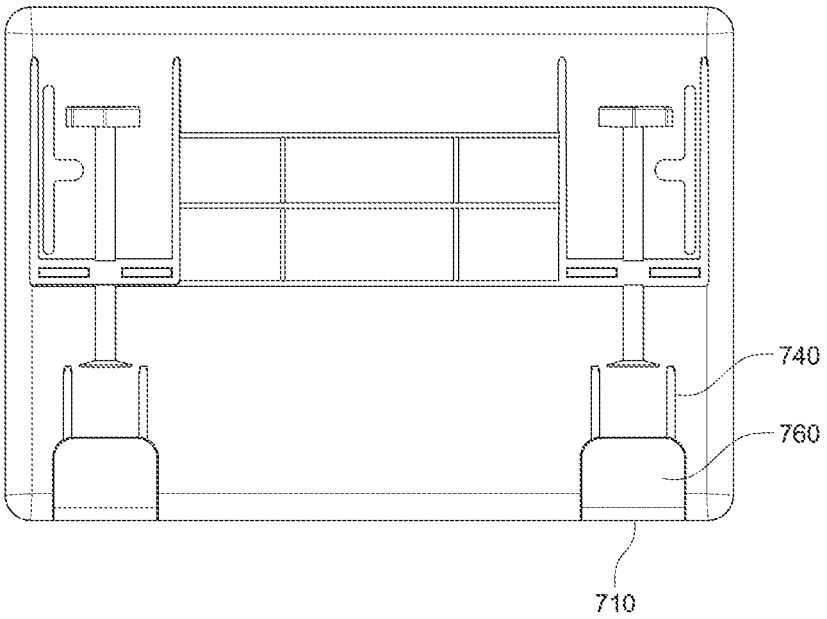
Figure 7F:
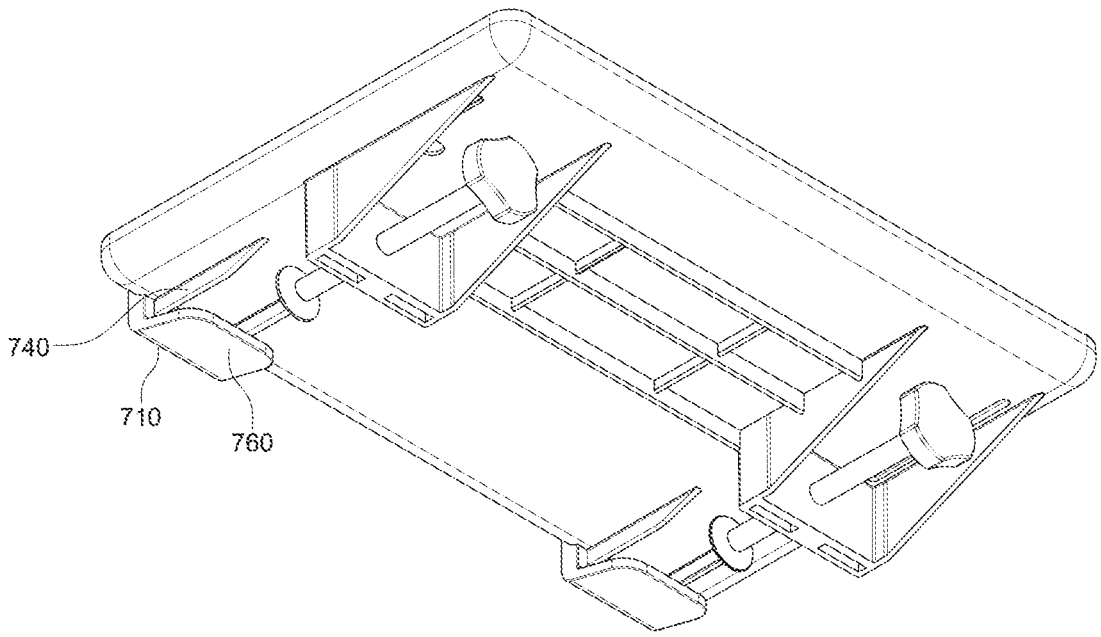
Figure 8A:
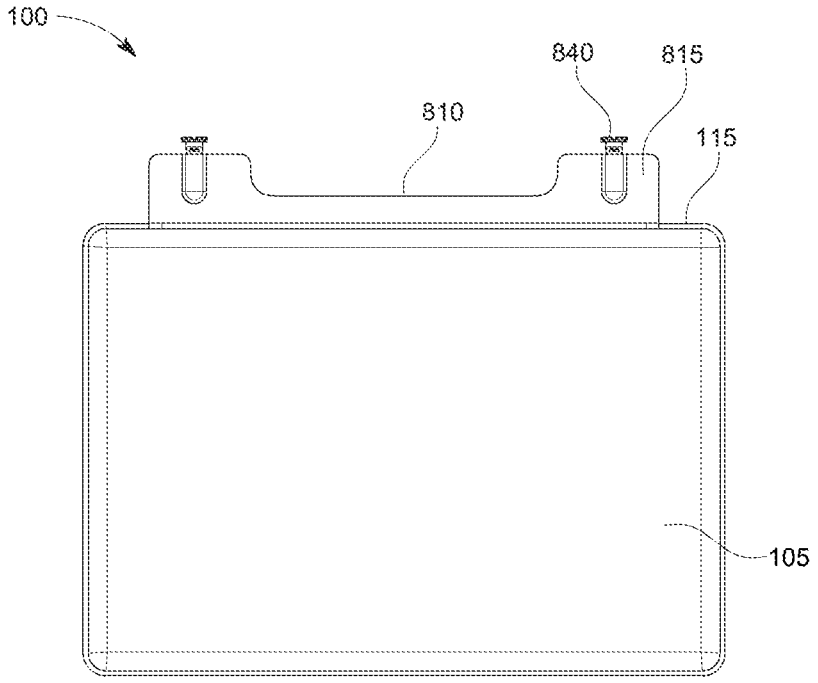
FIGS. 8A, 8B, 8C, 8D, 8E and 8F illustrate a utility tray according to an embodiment of the invention.
Figure 8B:
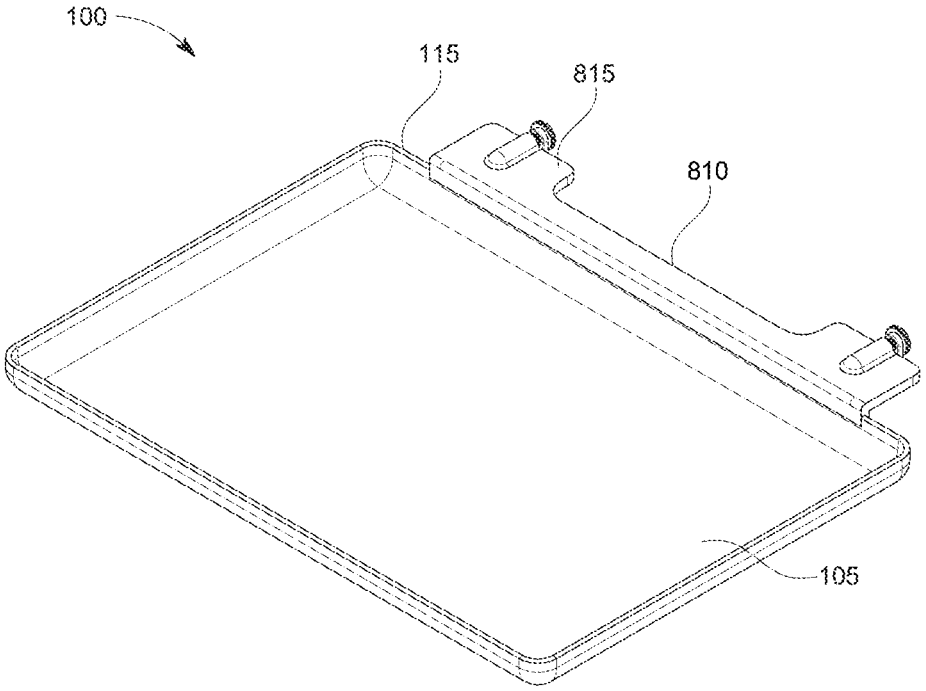
Figure 8C:
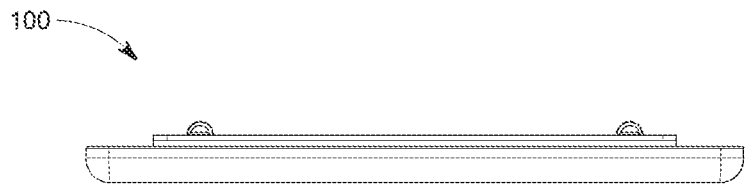
Figure 8D:
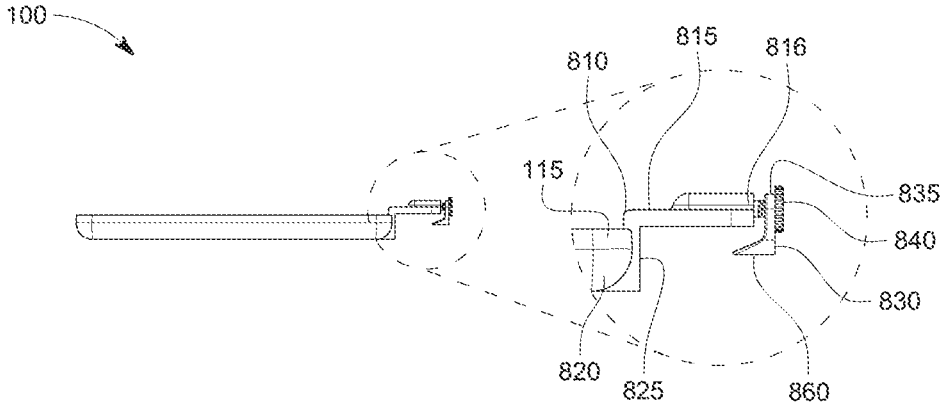
Figure 8E:
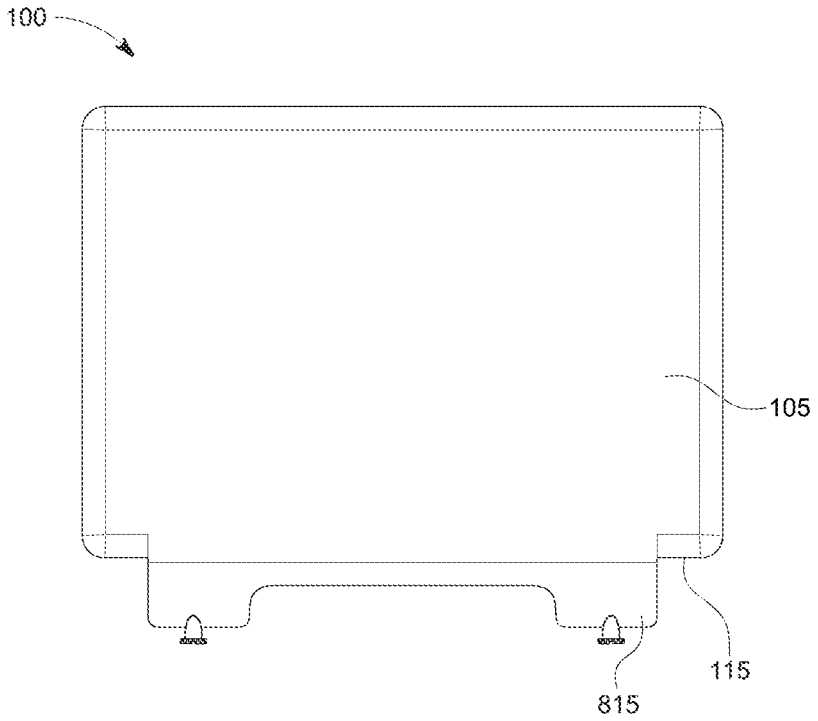
Figure 8F:
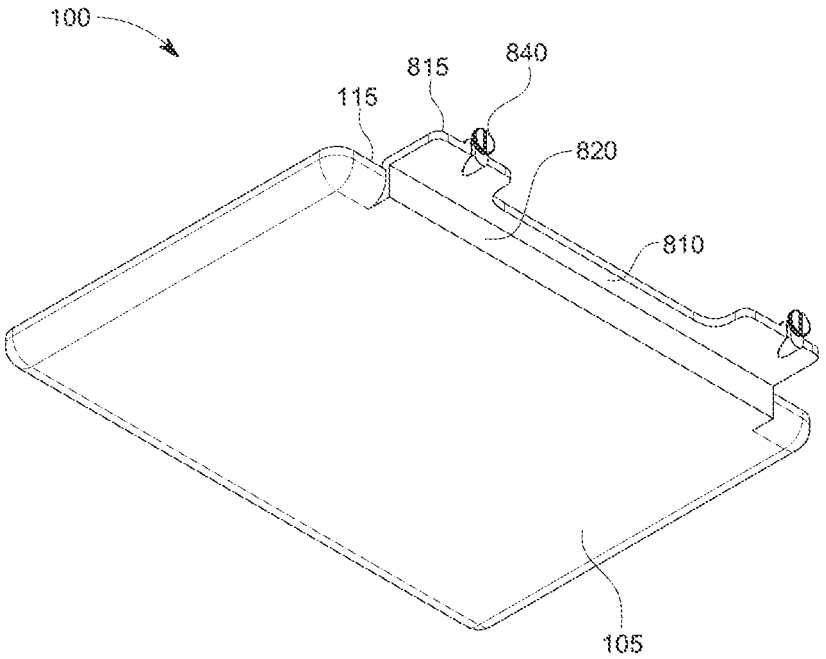
Figure 9A:
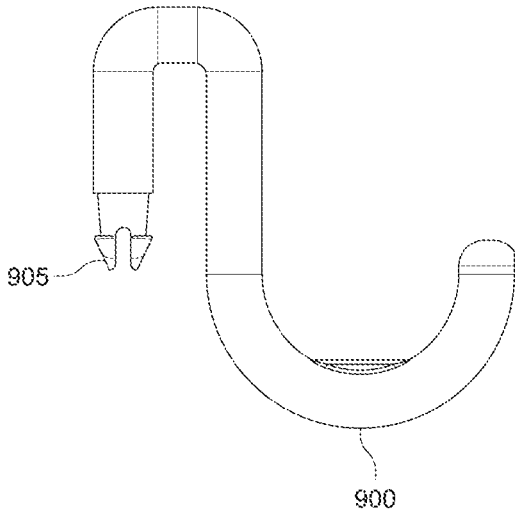
FIGS. 9A, 9B and 9C illustrate an accessory for a utility tray according to an embodiment of the invention.
Figure 9B:
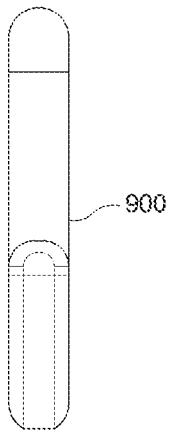
Figure 9C:
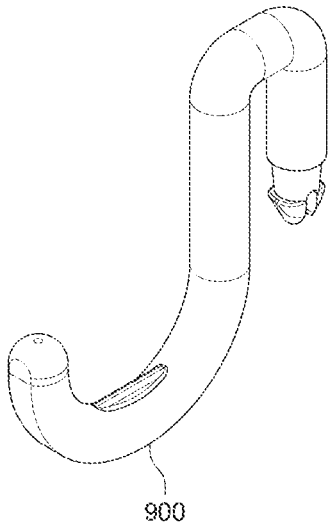
Figure 10A:
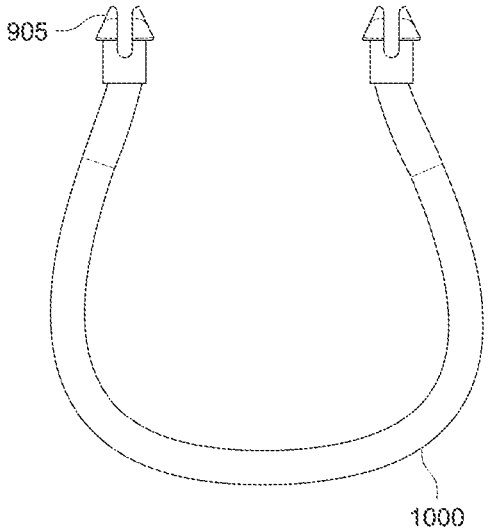
FIGS. 10A, 10B and 10C illustrate an accessory for a utility tray according to an embodiment of the invention.
Figure 10B:
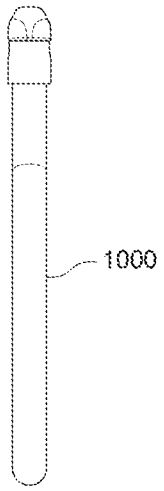
Figure 10C:
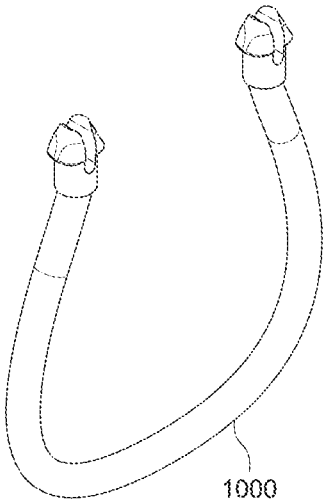
Figure 11A:
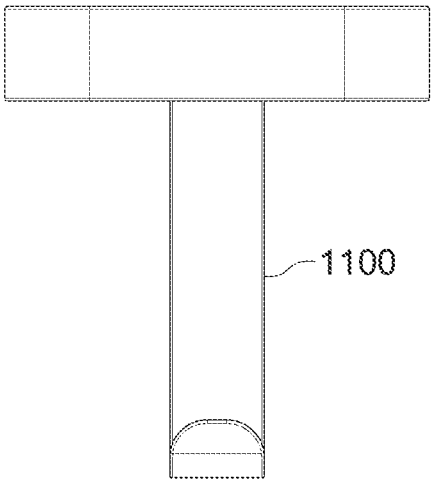
FIGS. 11A, 11B and 11C illustrate an accessory for a utility tray according to an embodiment of the invention.
Figure 11B:
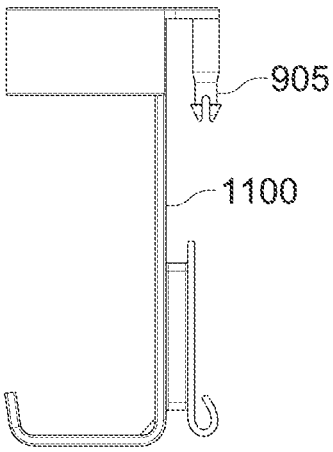
Figure 11C:
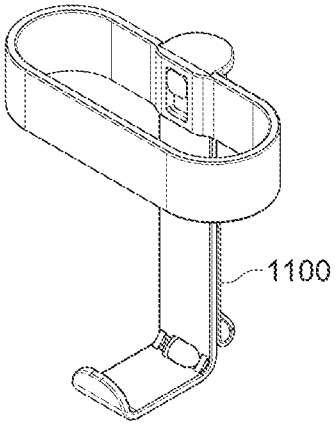
Figure 12A:
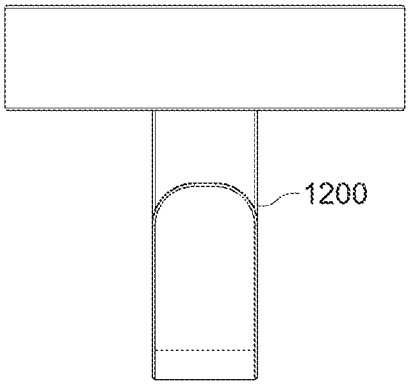
FIGS. 12A, 12B and 12C illustrate an accessory for a utility tray according to an embodiment of the invention.
Figure 12B:
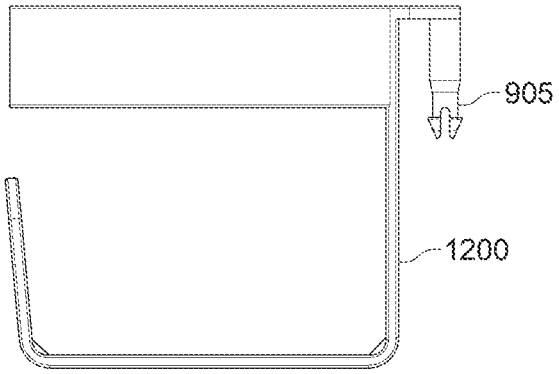
Figure 12C:
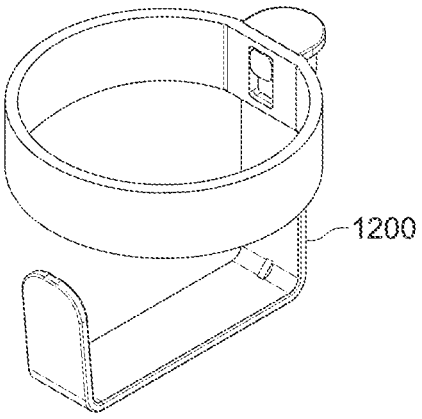
Figure 13A:
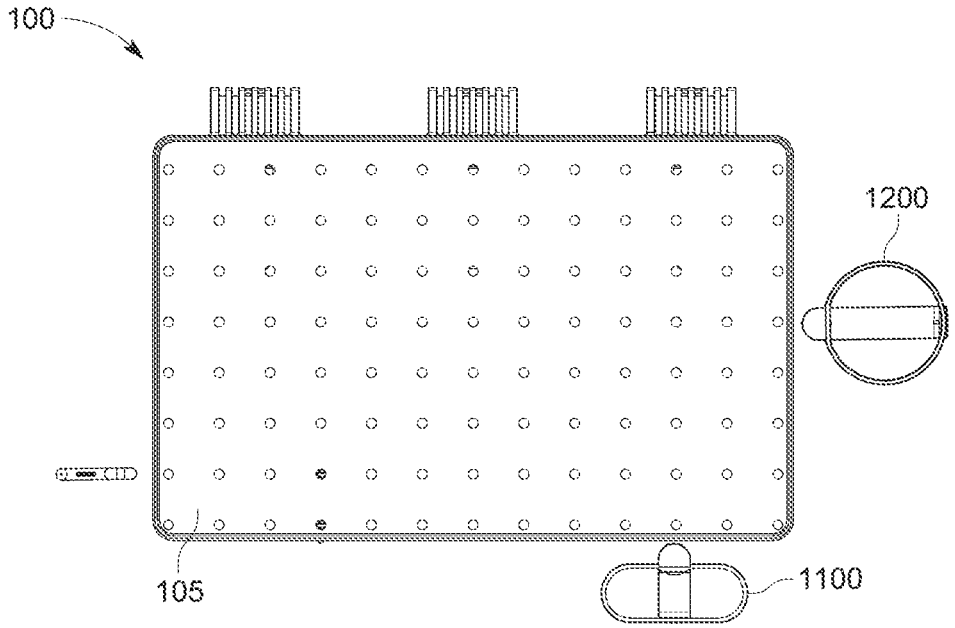
FIGS. 13A and 13B illustrate example positions of accessories for a utility tray according to an embodiment of the invention.
Figure 13B:
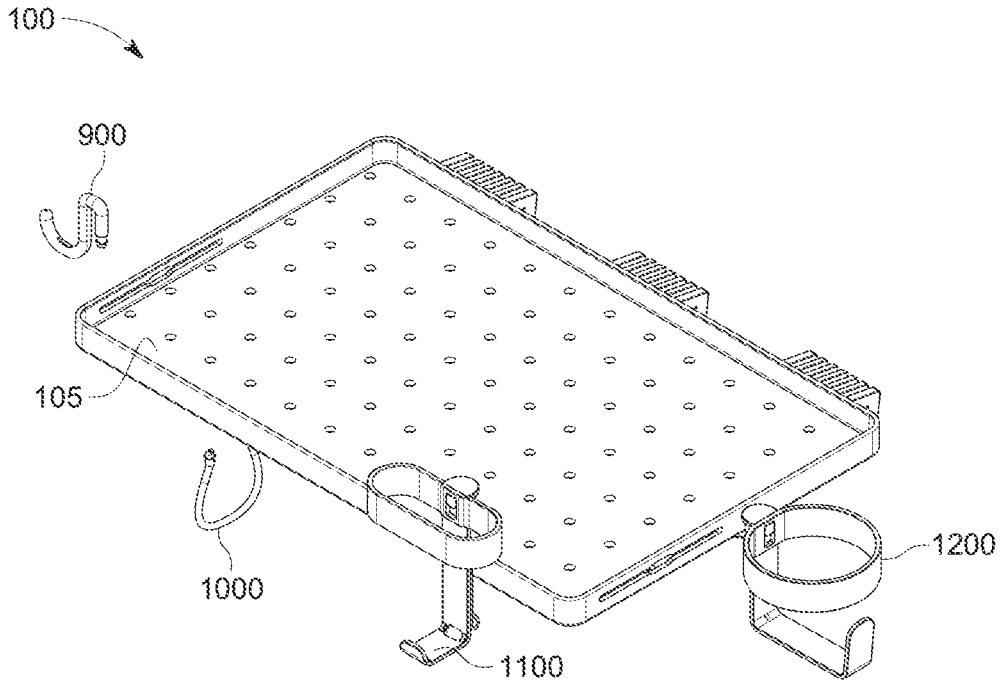
Figure 14A:
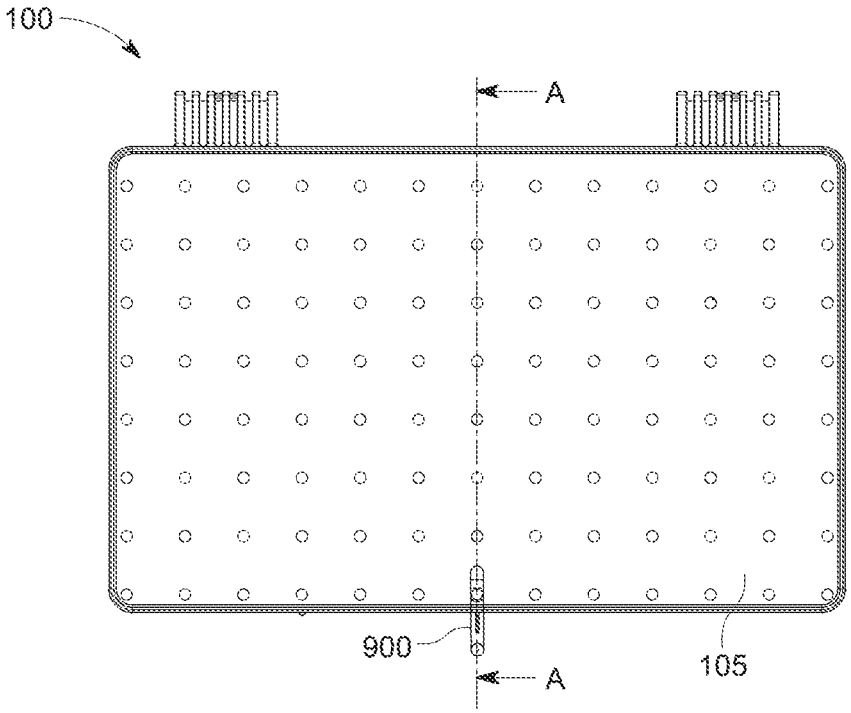
FIGS. 14A, 14B and 14C illustrate an attachment of an accessory to a utility tray according to an embodiment of the invention.
Figure 14B:
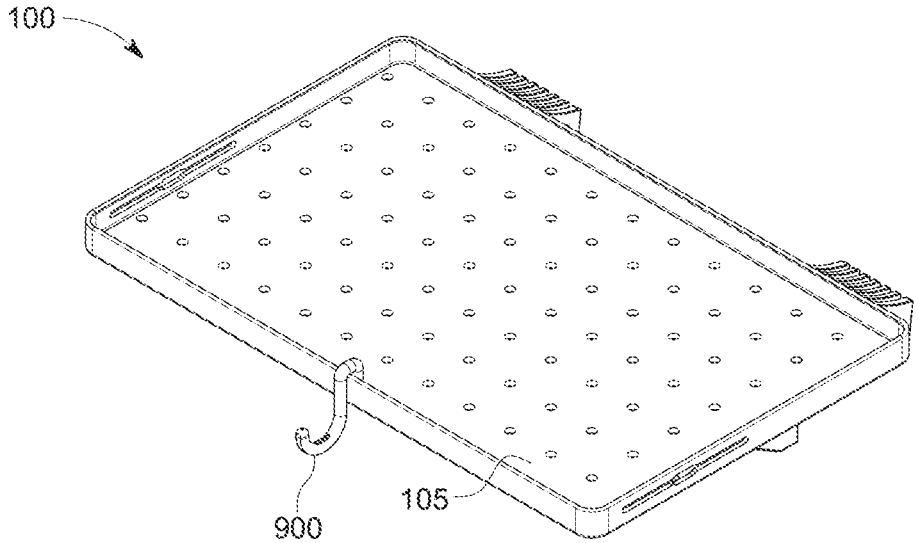
Figure 14C:
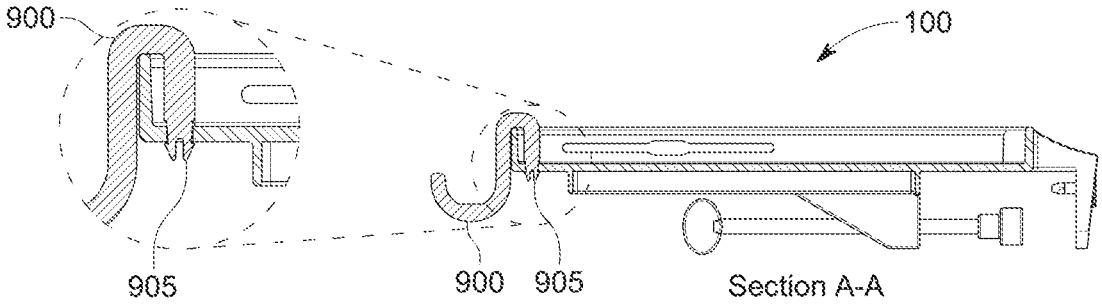
Figure 15A:
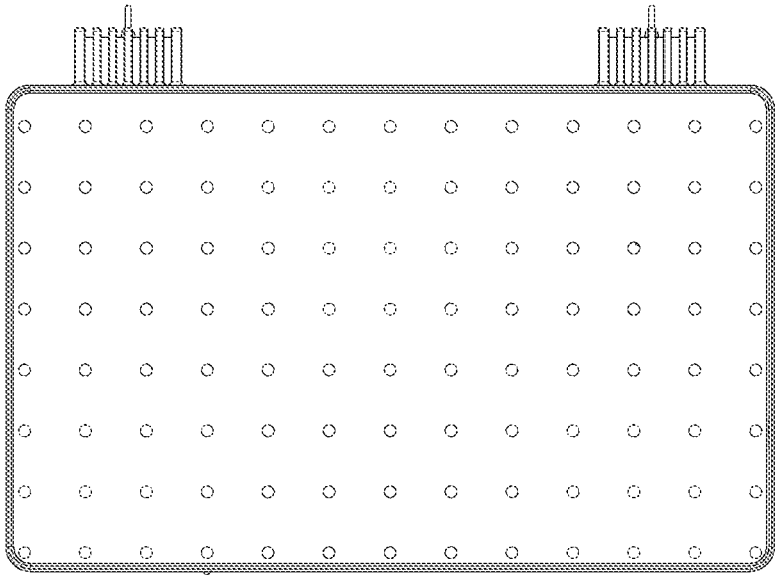
FIGS. 15A-15K illustrate aspects of a utility tray according to an embodiment of the invention.
Figure 15B:
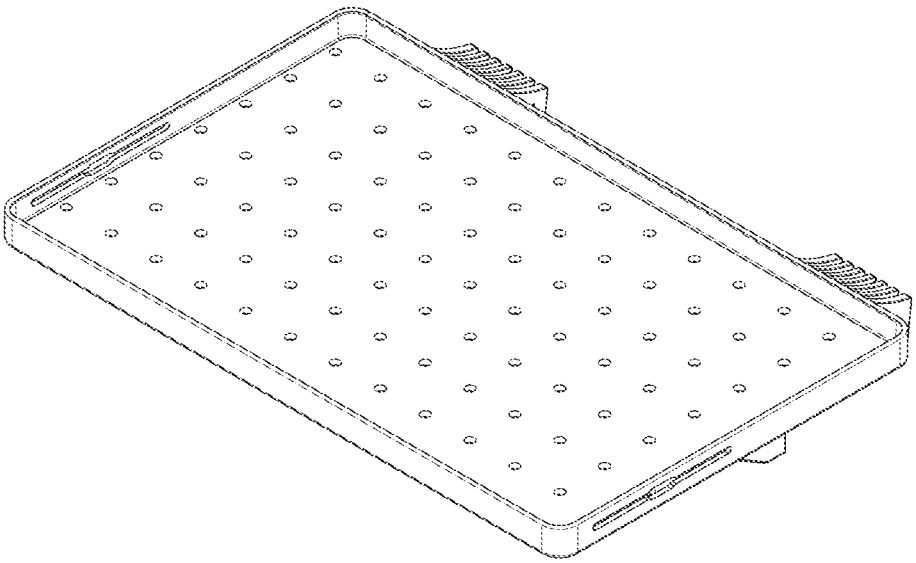
Figure 15C:
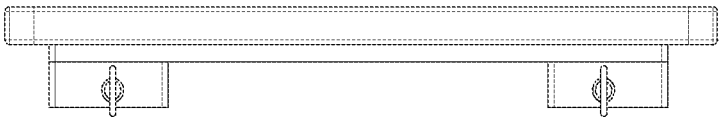
Figure 15D:
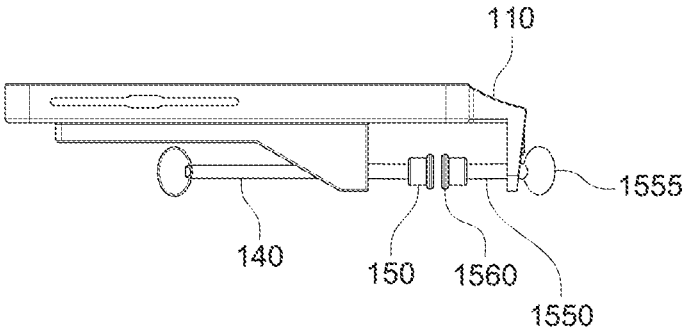
Figure 15E:
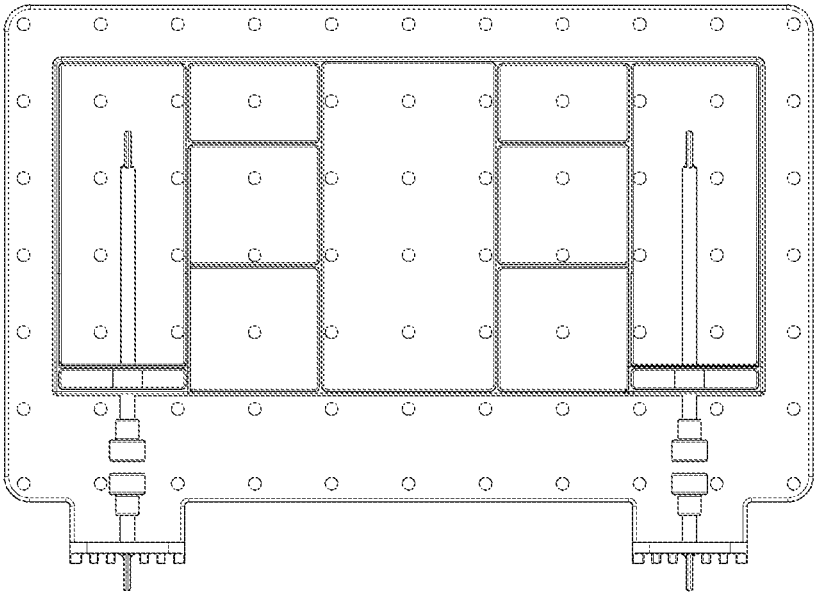
Figure 15F:
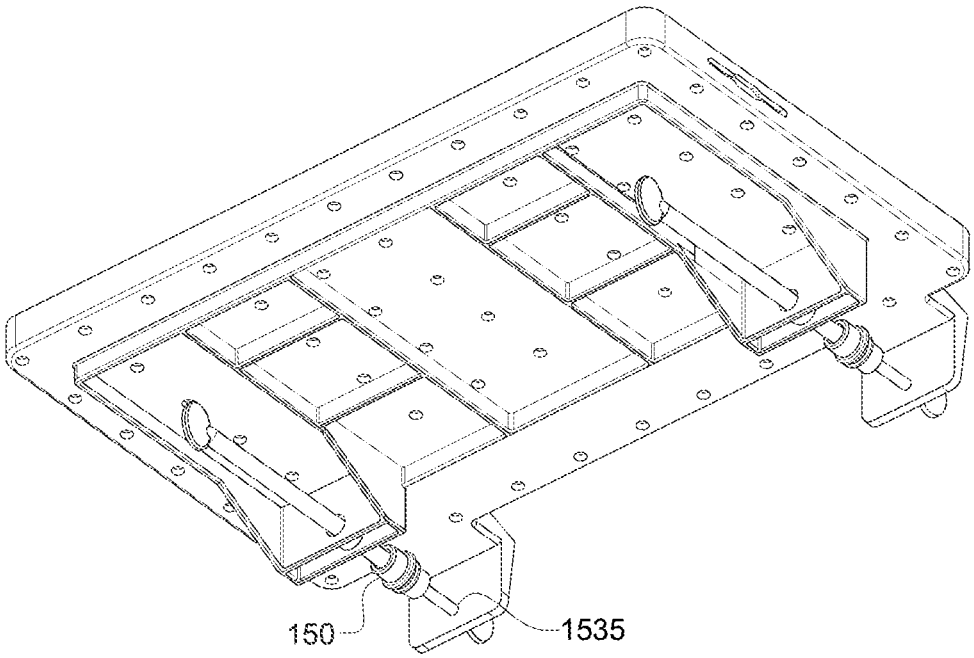
Figure 15G:
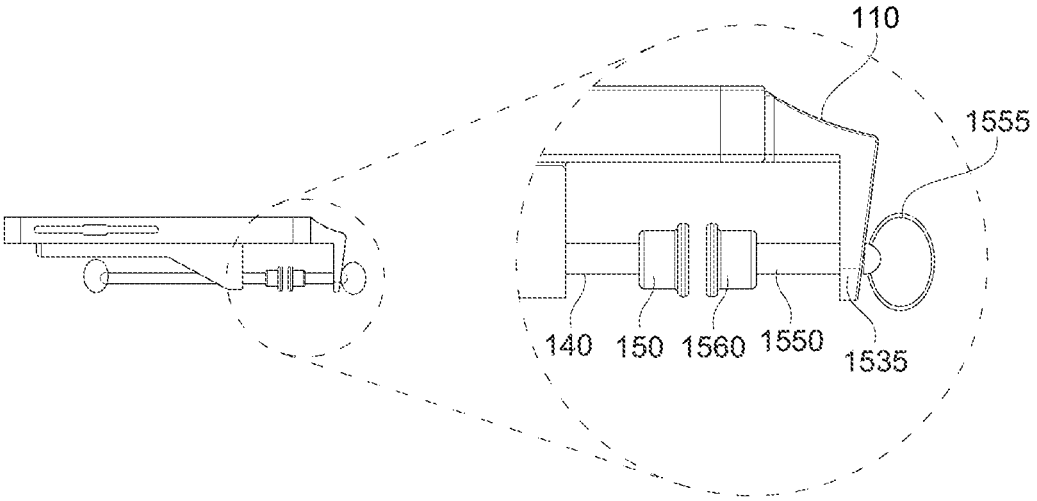
Figure 15H:
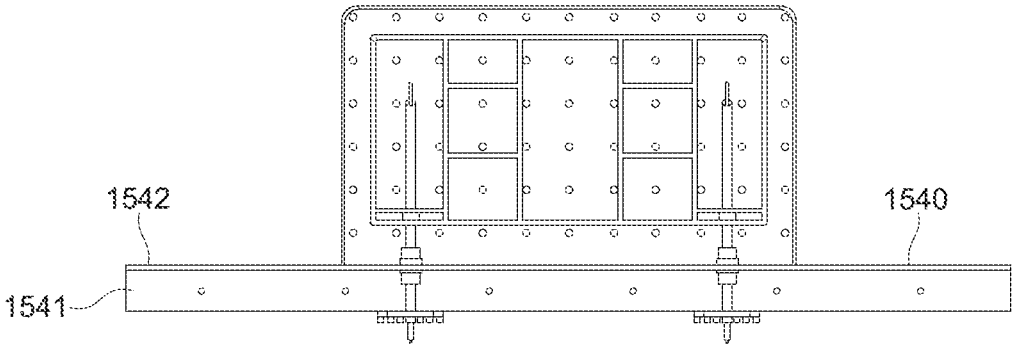
Figure 15I:
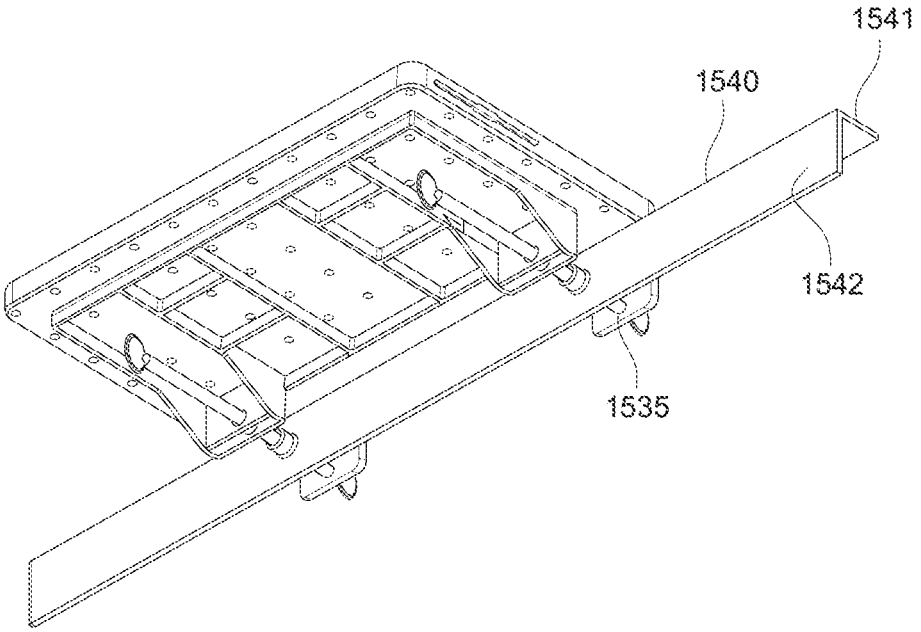
Figure 15J:
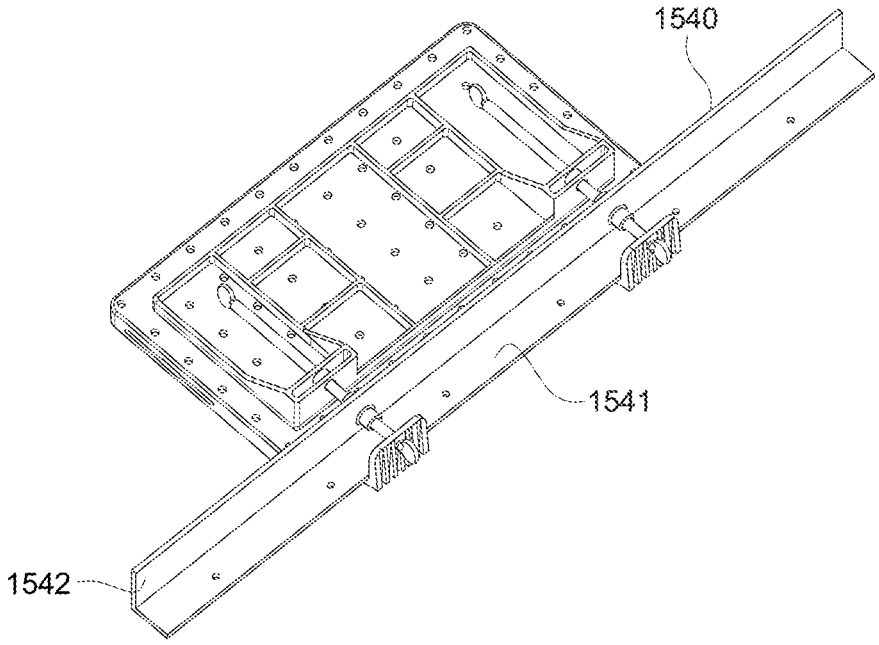
Figure 15K:
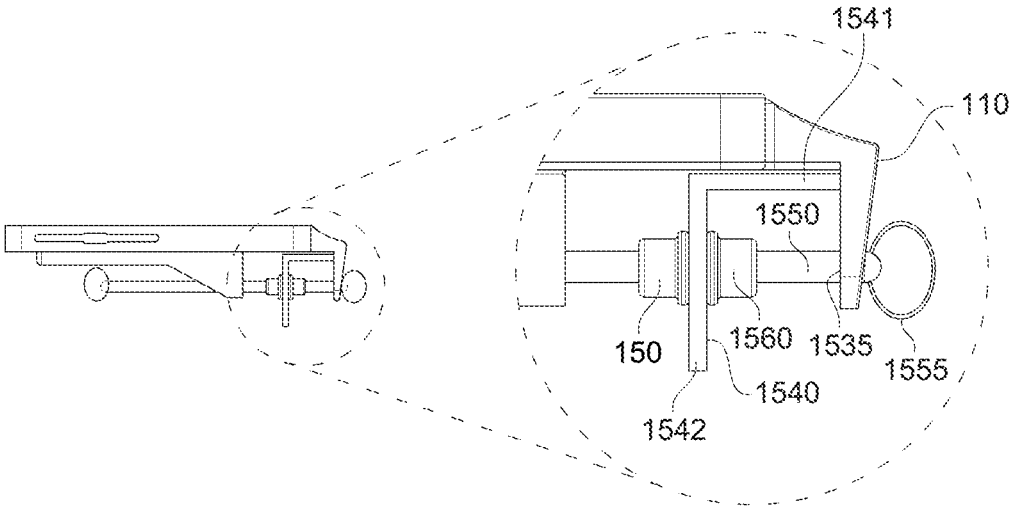

In one embodiment, with reference to FIGS. 6D, 6F, 7B, 7D, 7F, a vertical spacer (640, 740) is coupled to the bottom surface of base 105 next to edge 115 of the base to provide a vertical distance between the bottom surface of the base and a top surface of the support structure. Such spacing may be needed depending on other components coupled to the support structure. For example, as illustrated in FIGS. 4A and 4B, bed springs 436 are coupled at locations 437 to support structure 440 with sufficient horizontal clearance between the locations 437 and edge 115 of tray 100. However, if such horizontal clearance is not possible, then providing for vertical clearance with the use of vertical spacers, allows tray 100 to be firmly mounted to support structure 440 without contacting springs 436.

Figure 3A:
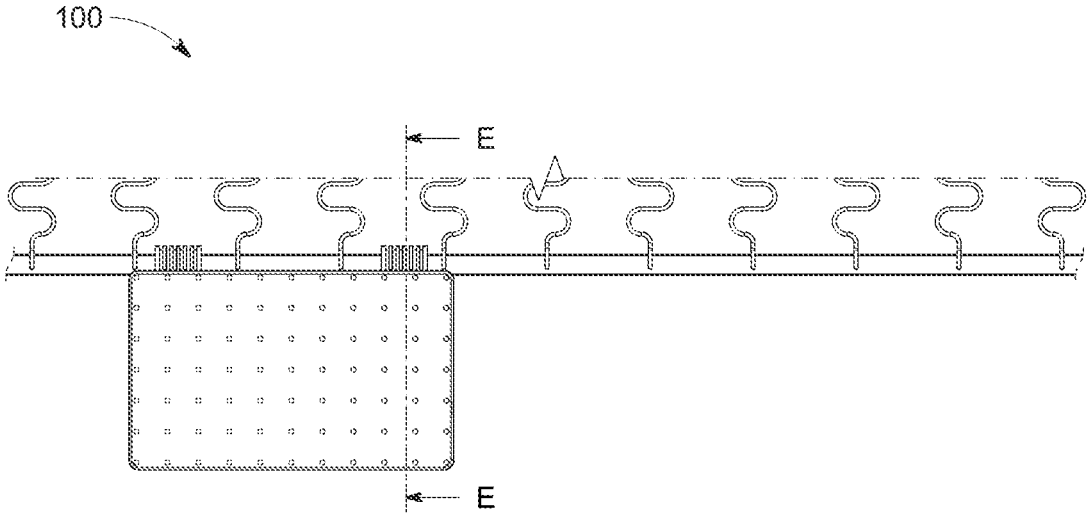
FIGS. 3A and 3B illustrate aspects of a utility tray according to an embodiment of the invention.
Figure 3B:
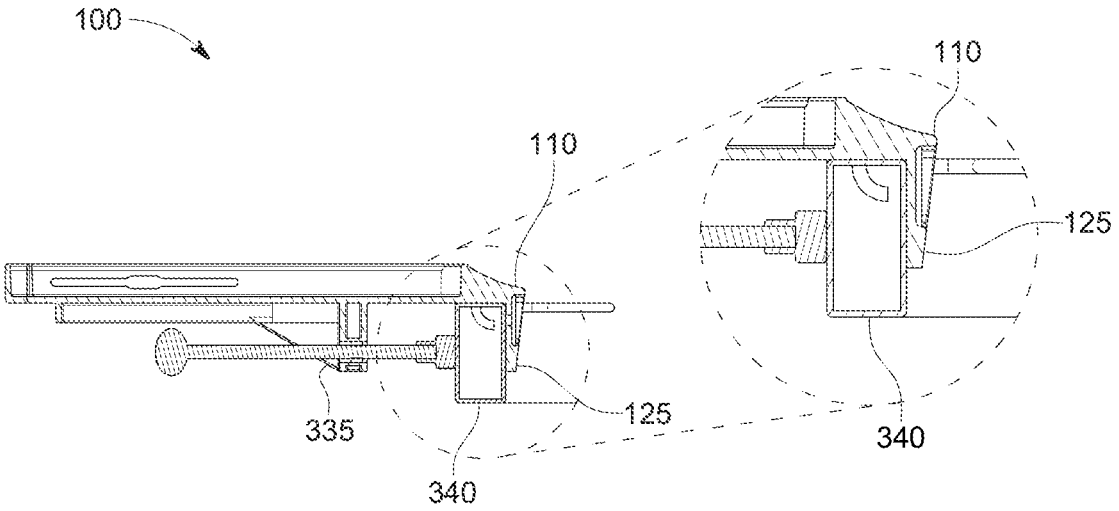

Quite commonly, with reference to FIGS. 3A and 3B, support structure 340 is a square or rectangular structure, for example, a hollow square or rectangular metal tube. In such a situation, vertically oriented side 125 of right-angle bracket 110 abuts a corresponding vertical side of support structure 340. However, with reference to FIGS. 1F, 2, 4A and 4B, it is contemplated that in some situations support structure 440 may be a right-angle support structure that has a horizontally oriented side 441 and a vertically oriented side 442 that extends downward from the horizontally oriented side 441. In such a situation, right-angle bracket 110 of tray 100 comprises a protruding member 260, 460 coupled to and extending from vertically oriented side 125 of right-angle bracket 110 of tray 100 in a substantially horizontal direction under at least a portion of the horizontally oriented side 441 of right-angle support structure 440. The protruding member 260, 460 in one embodiment comprises a pin or peg or nibble section 261, 461 that can pass through a corresponding hole 163, 263, 463 in right-angle bracket 110, and a head 262, 462. Once the tray with right-angle bracket 110 is positioned on support structure 440, protruding member 260, 460 may be installed by inserting peg 261, 461 into hole 163, 263, 463 and pushing on head 262, 462 until the head contacts vertically oriented surface 125.

The protruding member is positioned underneath the bottom surface of horizontally oriented side 441 of right-angle support structure 440 such that when downward pressure is applied to tray 100, the protruding member contacts the bottom surface of horizontally oriented side 441 of right-angle support structure 440 and prevents right-angle bracket 110 from rotating about or slipping on right-angle support structure 440, thereby preventing tray 100 from declining from its substantially horizontal orientation when weight or downward force is applied to tray 100.

While the embodiment illustrated herein shows the protruding member 260, 460 in the form of a peg, it is appreciated that the protruding member may be other shapes and sizes, such as a tab or lip extending in a horizontal direction from vertically oriented side 125 of right-angle bracket 110. For example, with reference to FIGS. 7B, 7D, 7E and 7F, protruding member 760 forms a tab or lip that declines from a horizontal plane as it extends from the vertically oriented side of bracket 710. In this embodiment, a portion of the protruding member 760 contacts at least a portion of the horizontally oriented side of a right-angle support structure.

In one embodiment of the invention illustrated in FIGS. 5A-5F, tray 100 is capable of being frictionally engaged to a support structure 540. The tray includes a horizontally oriented planar base 105 having an edge 115, and a right-angle bracket 510 molded or coupled proximate the edge of the base. The right-angle bracket has a horizontally oriented side 515 extending in a direction parallel to a plane of the base and capable of abutting a top horizontally oriented surface 541 of support structure 540, and a vertically oriented side 520 coupled to the horizontally oriented side of the right-angle bracket at a corner of the right-angle bracket and extending downward. The inside surface of the vertically oriented side can abut a vertical surface 542 of support structure 540. A strap 525 is capable of being coupled to an end or edge 530 of the horizontally oriented side of the right-angle bracket and extended around the support structure and to an end or edge 535 of the vertically oriented side of the right-angle bracket. The strap can be tightened to frictionally engage the right-angle bracket with the support structure.

Thus, this embodiment describes a tray, capable of being frictionally engaged to a support structure. The tray comprises a horizontally oriented planar base having an edge, a right-angle bracket coupled proximate the edge of the base, the right-angle bracket having: a horizontally oriented side extending in a direction parallel to a plane of the base and capable of abutting a top horizontally oriented surface of the support structure, and a vertically oriented side coupled to the horizontally oriented side of the right-angle bracket at a corner of the right-angle bracket and extending downward, an inside surface of which is capable of abutting a vertical surface of the support structure. The embodiment further comprises a strap that can be coupled to an edge of the horizontally oriented side of the right-angle bracket, extended around the support structure and to an edge of the vertically oriented side of the right-angle bracket, and tightened to frictionally engage the right-angle bracket with the support structure.

In one embodiment of the invention illustrated in FIGS. 6A-6F, rather than the right-angle bracket 110 in the embodiments discussed above, this embodiment uses only a vertical bracket 610, that is, a bracket that extends downward in a vertical direction from edge 115 of tray 100. This embodiment includes a protruding member 660 which serves the same purpose as described above. Thus, in this embodiment, tray 100 is capable of being frictionally engaged to a right-angle support structure that has a horizontally oriented side and a vertically oriented side that extends downward from the horizontally oriented side. As in the previously described embodiments, the tray includes a horizontally oriented planar base 105 having an edge 115. The vertical bracket 610 is molded or coupled adjacent the edge of base 105 and extends downward in a direction substantially normal to the base. The protruding member 660 is coupled to and extends from the vertical bracket 610 in a substantially horizontal direction under at least a portion of the horizontally oriented side of the right-angle support structure. Another bracket 130 is coupled to a bottom surface of the base and extends downward in the direction substantially normal to the base. Bracket 130 is positioned opposite bracket 610 a sufficient horizontal distance to receive the support structure positioned therebetween. A screw 140 comprises a head or handle 145 at a first end of the screw and a shoe 150 at a second end of the screw. The second end of the screw passes through a threaded hole 635 of bracket 130 and extends toward bracket 610, wherein movement of (e.g., turning) the handle causes shoe 150 and bracket 610 to frictionally engage the support structure positioned therebetween. While this embodiment illustrates a vertical spacer 640, it is appreciated that the vertical spacer is an optional feature.

Thus, this embodiment describes a tray, capable of being frictionally engaged to a right-angle support structure that has a horizontally oriented side and a vertically oriented side that extends downward from the horizontally oriented side. The tray comprises a horizontally oriented planar base having an edge, a first bracket coupled adjacent the edge of the base and extending downward in a direction substantially normal to the base, a protruding member coupled to and extending from the first bracket in a substantially horizontal direction under at least a portion of the horizontally oriented side of the right-angle support structure, a second bracket, having a threaded hole, coupled to a bottom surface of the base and extending downward in the direction substantially normal to the base, the second bracket positioned opposite the first bracket a horizontal distance sufficient to receive the support structure positioned therebetween, and a screw comprising a handle at a first end of the screw and a shoe at a second end of the screw, the second end of the screw passing through the threaded hole of the second bracket and extending toward the first bracket, wherein movement of the handle causes the shoe and the first bracket to frictionally engage the support structure positioned therebetween.

Finally, another embodiment is illustrated in FIGS. 8A-8F. This embodiment involves a tray 100 capable of being frictionally engaged to a support structure (not shown in the figures) as well. The tray includes a horizontally oriented planar base 105 having an edge 115, and a right-angle bracket 810 coupled proximate the edge of the base. The right-angle bracket has a horizontally oriented side 815 extending in a direction parallel to a plane of the base that is capable of abutting a top, horizontally oriented, surface of the support structure. The right-angle bracket further has a vertically oriented side 820 coupled to the horizontally oriented side of the right-angle bracket at a corner of the right-angle bracket and extending downward. An inside surface 825 of the vertically oriented side 820 can abut a vertical surface of the support structure.

This embodiment further includes a bracket 830, having a threaded hole 835, the bracket extending downward in a direction substantially normal to the base and positioned opposite the right-angle bracket a sufficient horizontal distance to receive the support structure positioned therebetween. A screw 840 passes through threaded hole 835 of bracket 830 and can engage a threaded hole 816 of right-angle bracket 815, wherein turning the screw while the screw is engaged with threaded hole 816 of right-angle bracket 810 shortens the horizontal distance between bracket 830 and right-angle bracket 810, thereby causing bracket 830 and right-angle bracket 810 to frictionally engage the support structure positioned therebetween. In some situations, the support structure is a right-angle support structure that has a horizontally oriented side and a vertically oriented side that extends downward from the horizontally oriented side. In such situations, the bracket 830 comprises a protruding member 860 coupled to and extending from bracket 830 in a substantially horizontal direction under at least a portion of the horizontally oriented side of the right-angle support structure.

It is contemplated that at least a portion of the protruding member 860 coupled to bracket 830 extends in the substantially horizontal direction under at least the portion of the horizontally oriented side of the right-angle support structure and may abut the portion of the horizontally oriented side of the right-angle support structure.

Thus, this embodiment describes a tray, capable of being frictionally engaged to a support structure. The tray comprises a horizontally oriented planar base having an edge, a right-angle bracket coupled proximate the edge of the base, the right-angle bracket having: a horizontally oriented side extending in a direction parallel to a plane of the base, having a threaded hole, and capable of abutting a top, horizontally oriented, surface of the support structure, and a vertically oriented side coupled to the horizontally oriented side of the right-angle bracket at a corner of the right-angle bracket and extending downward, an inside surface of which is capable of abutting a vertical surface of the support structure. This embodiment further comprises a bracket, having a threaded hole, the bracket extending downward in a direction substantially normal to the base and positioned opposite the right-angle bracket a horizontal distance sufficient to receive the support structure positioned therebetween, a screw passing through the threaded hole of the bracket and capable of engaging the threaded hole of the right-angle bracket, wherein turning the screw while the screw is engaged with the threaded hole of the right-angle bracket shortens the horizontal distance between the bracket and the right-angle bracket, thereby causing the bracket and right-angle bracket to frictionally engage the support structure positioned therebetween.

In this embodiment, the support structure may be a right-angle support structure that has a horizontally oriented side and a vertically oriented side that extends downward from the horizontally oriented side, and the bracket may be a protruding member coupled to and extending from the bracket in a substantially horizontal direction under at least a portion of the horizontally oriented side of the right-angle support structure.

In this embodiment, at least a portion of the protruding member coupled to and extending from the bracket in the substantially horizontal direction under at least the portion of the horizontally oriented side of the right-angle support structure abuts the portion of the horizontally oriented side of the right-angle support structure.

With reference to FIGS. 15A-15K, it is contemplated that in some situations support structure 1540 may be a right-angle support structure that has a horizontally oriented side 1541 and a vertically oriented side 1542 that extends downward from the horizontally oriented side 1541. In such a situation, right-angle bracket 110 of tray 100 includes a threaded hole 1535. A threaded fixing, for example, a bolt, or a screw, 1550 comprising a head or handle 1555 at a first end of the screw and a shoe 1560 at a second end of the screw is inserted through threaded hole 1535 such that the second end of the screw passes through the threaded hole of right-angle bracket 110 and extends toward the vertically oriented side 1542 of right-angle support structure 1540. Turning the head or the handle 1555 of screw 1550 causes the shoe 1560 to move toward, engage and trap the vertically oriented side of right-angle support structure between shoe 1560 and the opposing shoe 150 of screw or bolt 140. As the head or handle 1555 is turned after the support structure is trapped between shoes 150 and 1560, the shoes frictionally engage the vertically oriented side of the support structure positioned therebetween. In this manner, items (e.g., a laptop computer, a book, and various accessories, etc.) can be placed on and weigh down the tray, or an upward force could be applied to the tray, for example, someone pulling up on the tray, and yet the tray is held firm in a substantially horizontal position to the right-angle support structure. While the embodiments illustrated in FIGS. 15A-15K and 16A, 16B contemplate use of a right-angle bracket, it is appreciated that this embodiment may be adapted to use a vertical bracket, such as described in the embodiment of the invention illustrated in FIGS. 6A-6F, which uses only a vertical bracket 610, that is, a bracket that extends downward in a vertical direction from edge 115 of tray 100. This embodiment may also optionally make use of a vertical spacer 640, as described in the embodiment of the invention illustrated in FIGS. 6A-6F.

Figure 16A:
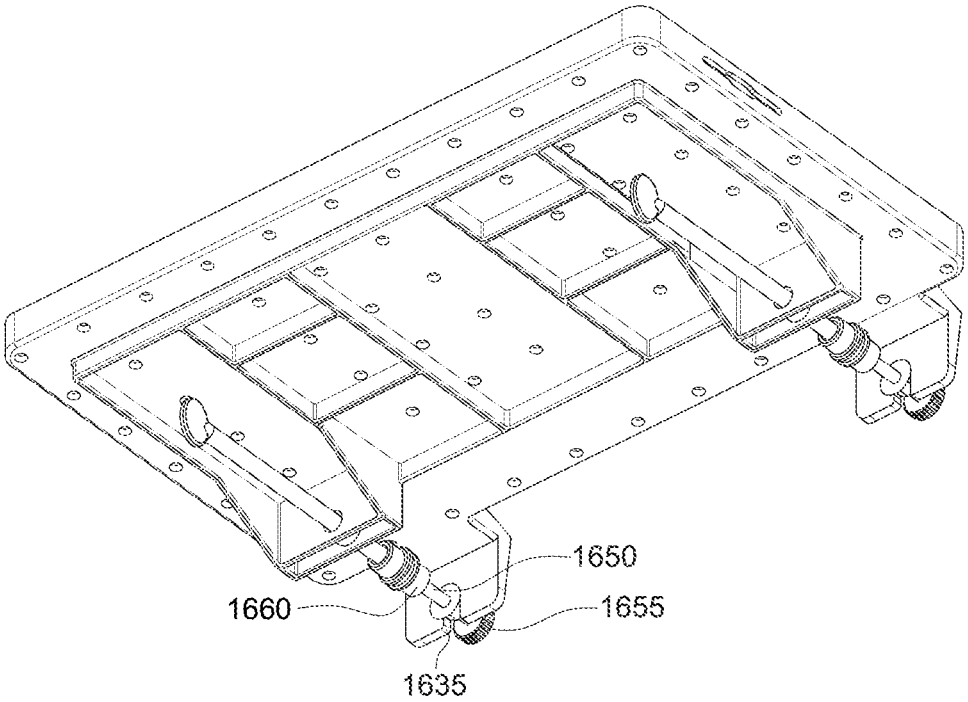
FIGS. 16A and 16B illustrate aspects of a utility tray according to an embodiment of the invention.
Figure 16B:
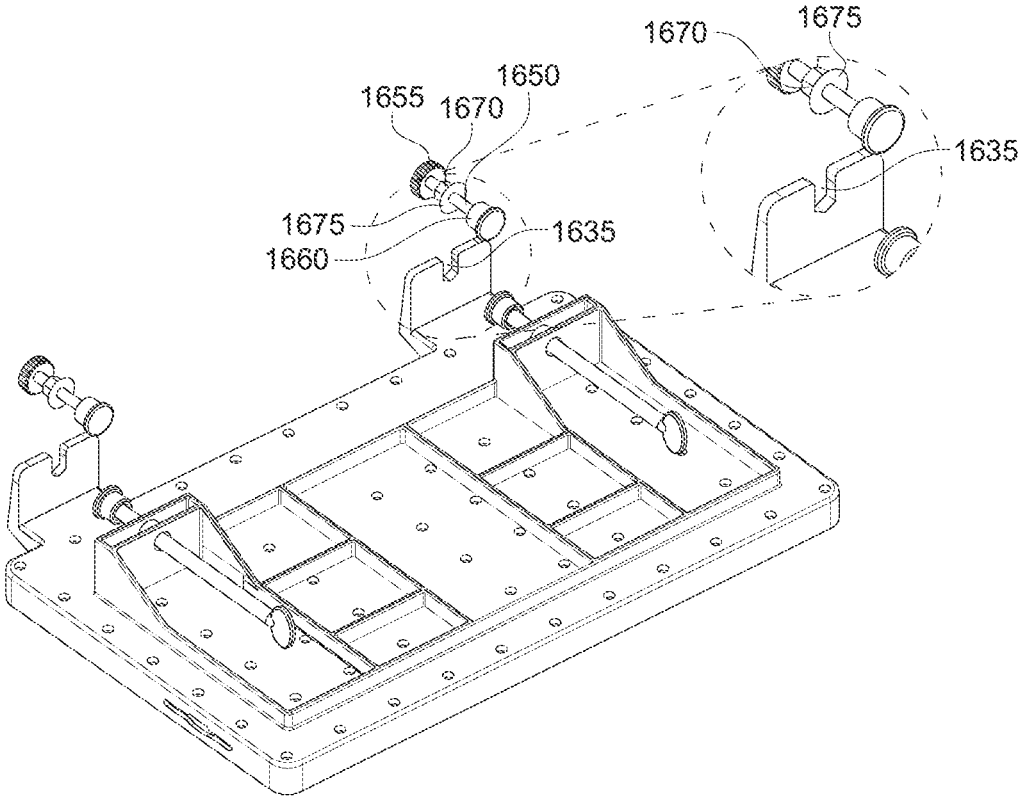
Figure 17A:
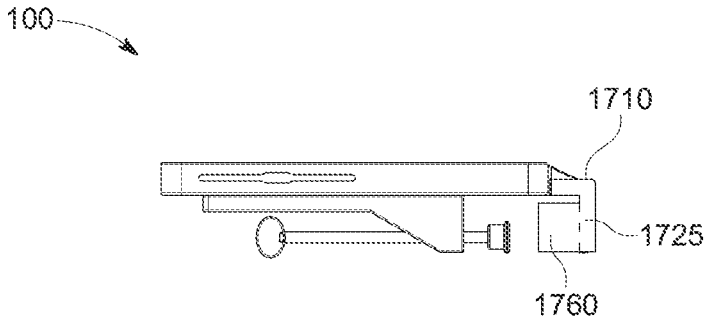
FIGS. 17A-17H illustrate aspects of a utility tray according to an embodiment of the invention.
Figure 17B:
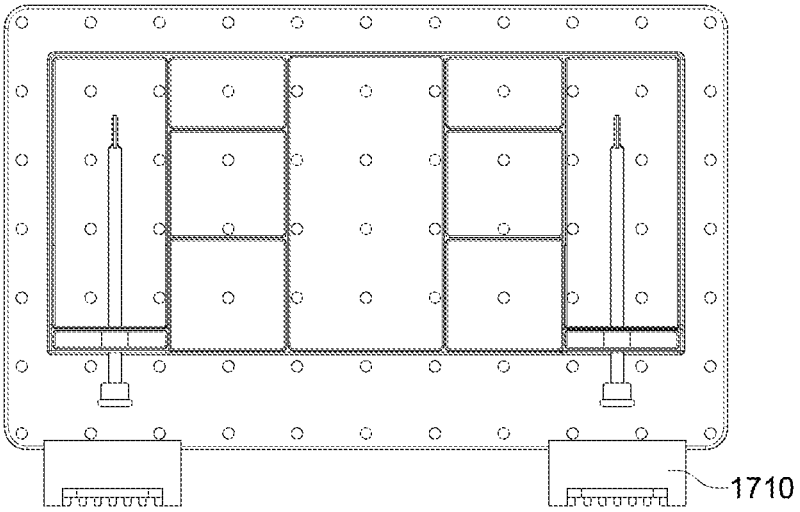
Figure 17C:
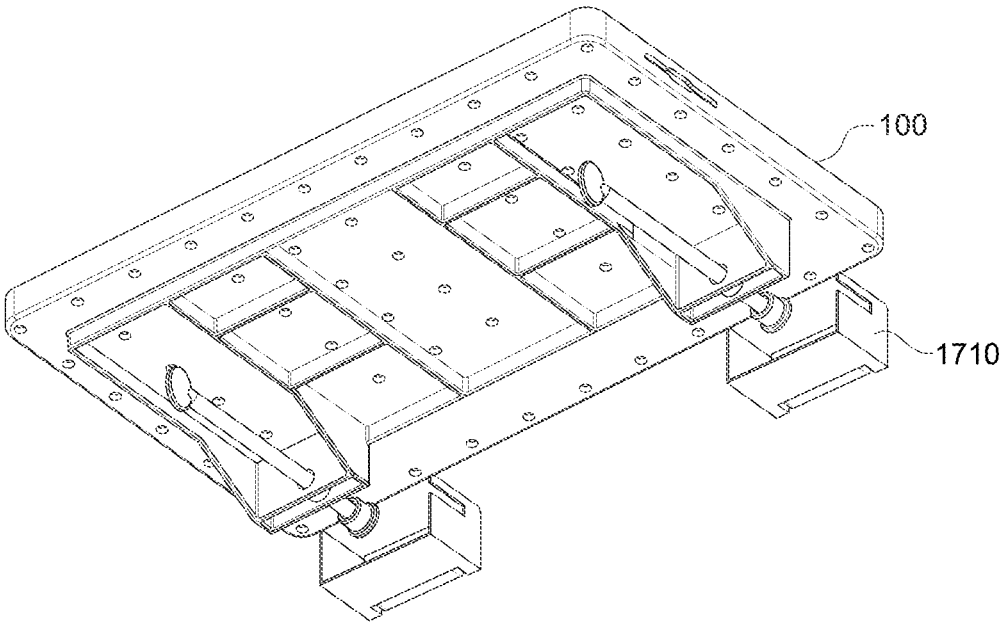
Figure 17D:
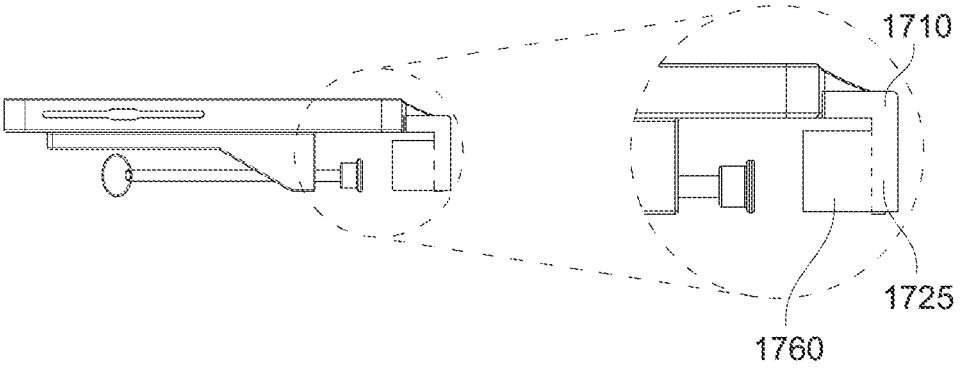
Figure 17E:
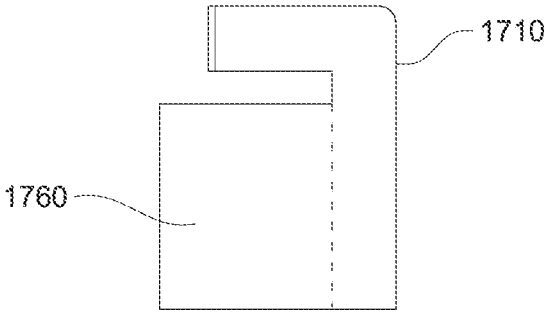
Figure 17F:
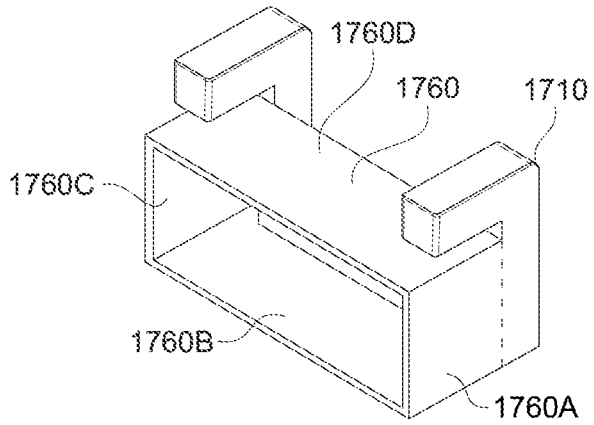
Figure 17G:
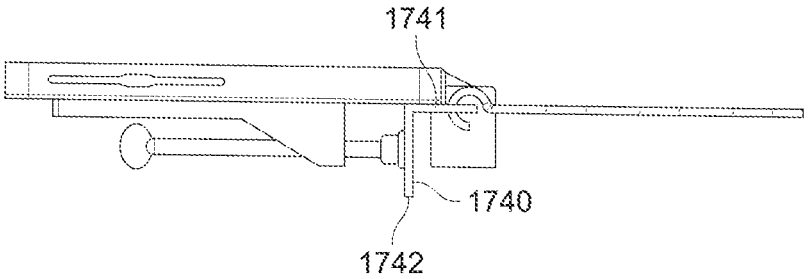
Figure 17H:
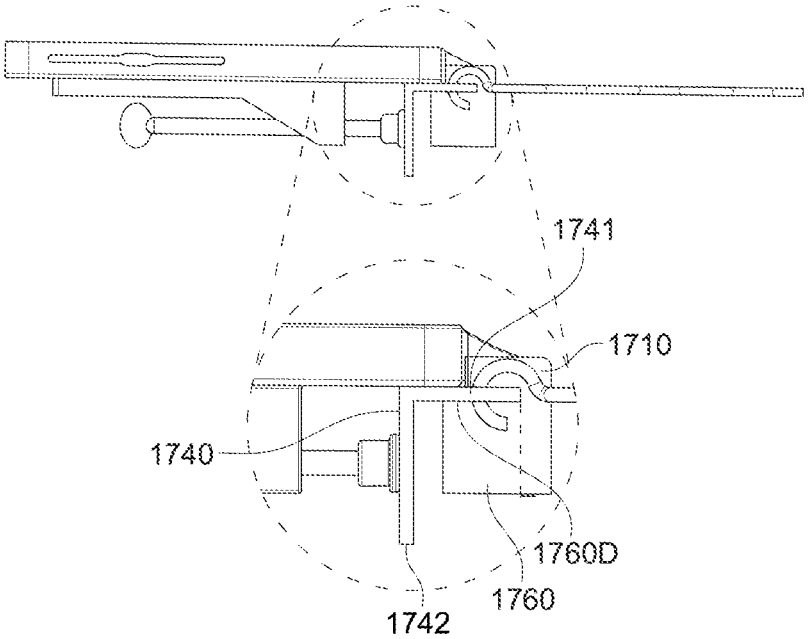

In an alternative embodiment illustrated in FIGS. 16A and 16B, right-angle bracket 110 of tray 100 includes a polygonal shaped slot 1635 instead of a threaded hole. A threaded fixing, for example, a bolt, or a screw, 1650 comprising a head or handle 1655 at a first end of the screw, a shoe 1660 at a second end of the screw, and a similarly sized and shaped polygonal shaped nut threaded onto a midsection of the screw 1650, is inserted through slot 1635 such that the second end of the screw passes through the slot of right-bracket 110 and extends toward the vertically oriented side of right-angle support structure. In particular, polygonal shaped nut 1670, appropriately dimensioned and positioned, is inserted into slot 1635. Turning the head or the handle 1655 of screw 1650 causes the screw to turn, while nut 1670 is held in place by slot 1635 and does not rotate as the screw is turned. Turning the head causes shoe 1660 to move toward, engage and trap the vertically oriented side of right-angle support structure between shoe 1660 and the opposing shoe 150 of screw or bolt 140. A washer 1675 prevents nut 1670 from leaving slot 1635 as the shoe 1660 is moved toward and engages the vertically oriented side of right-angle support structure. As the head or handle 1655 is turned after the support structure is trapped between shoes 150 and 1660, the shoes frictionally engage the vertically oriented side of the support structure positioned therebetween. In this manner, items (e.g., a laptop computer, a book, and various accessories, etc.) can be placed on and weight down the tray, or an upward force could be applied to the tray, for example, someone pulling up on the tray, and yet the tray is held firm in a substantially horizontal position to the right-angle support structure.

As noted above, and with reference to FIGS. 17A-17H, it is contemplated that in some situations support structure 1740 may be a right-angle support structure that has a horizontally oriented side 1741 and a vertically oriented side 1742 that extends downward from the horizontally oriented side 1741. In such a situation, a right-angle bracket 1710 of tray 100 comprises a protruding member in the form of block 1760 integrated with (e.g., molded as part of) and extending from vertically oriented side 1725 of right-angle bracket 1710 of tray 100 in a substantially horizontal direction under at least a portion of the horizontally oriented side 1741 of right-angle support structure 1740. The block 1760 in one embodiment is hollow, defined by four walls, including a first side wall 1760A, a bottom wall 1760B, a second side wall 1760C and top wall 1760D. In another embodiment, the block may be a solid block. Once the tray with right-angle bracket 1710 is positioned on support structure 1740, the top surface of top wall 1760D is positioned just underneath the bottom surface of horizontally oriented side 1741 of right-angle support structure 1740 such that when downward or upward pressure is applied to tray 100, the block 1760 contacts the bottom surface of horizontally oriented side 1741 of right-angle support structure 1740 and prevents right-angle bracket 1710 from rotating about or slipping on right-angle support structure 1740, thereby preventing tray 100 from declining or inclining from its substantially horizontal orientation when downward or upward force is applied to tray 100.

Figure 18A:
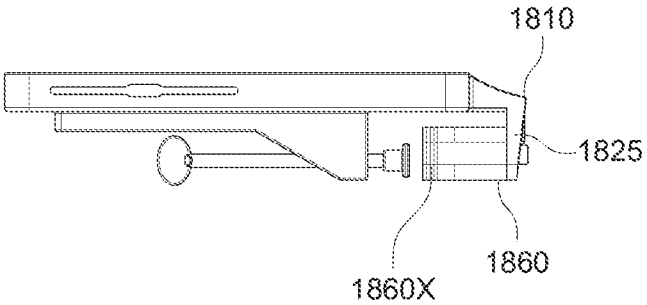
FIGS. 18A-18I illustrate aspects of a utility tray according to an embodiment of the invention.
Figure 18B:
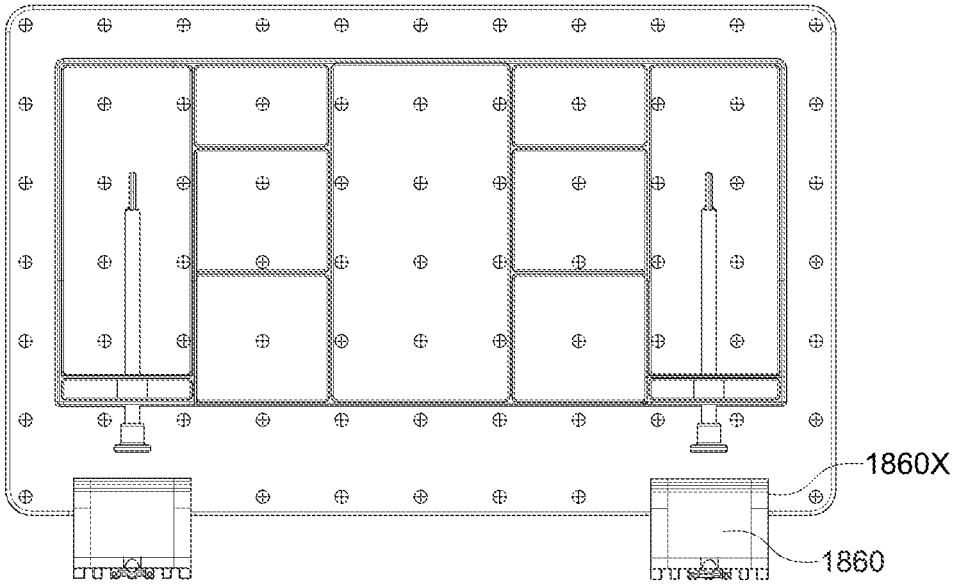
Figure 18C:
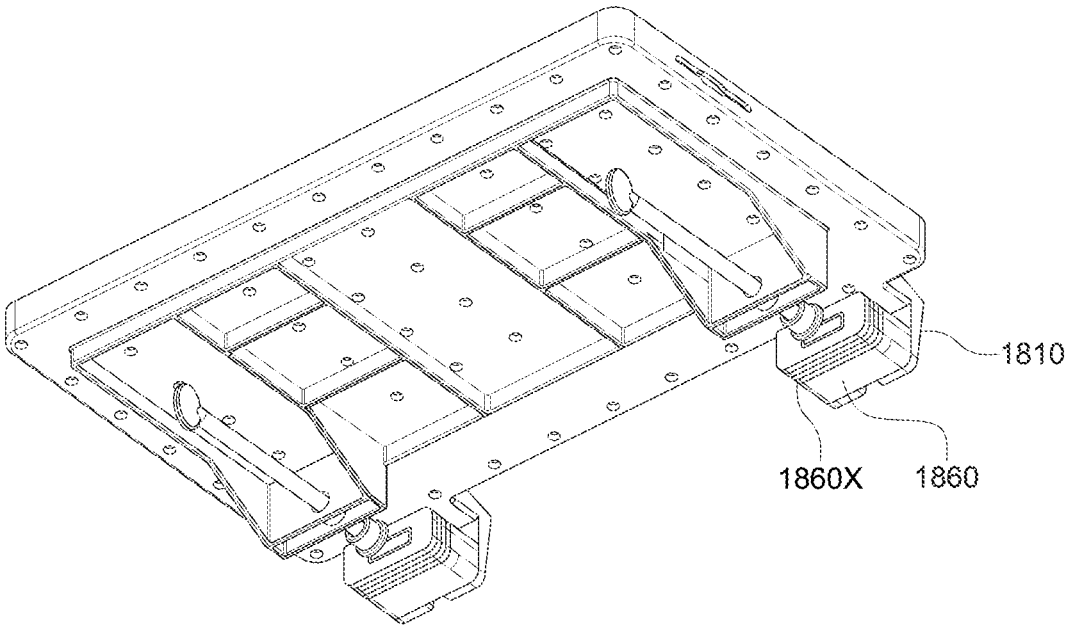
Figure 18D:
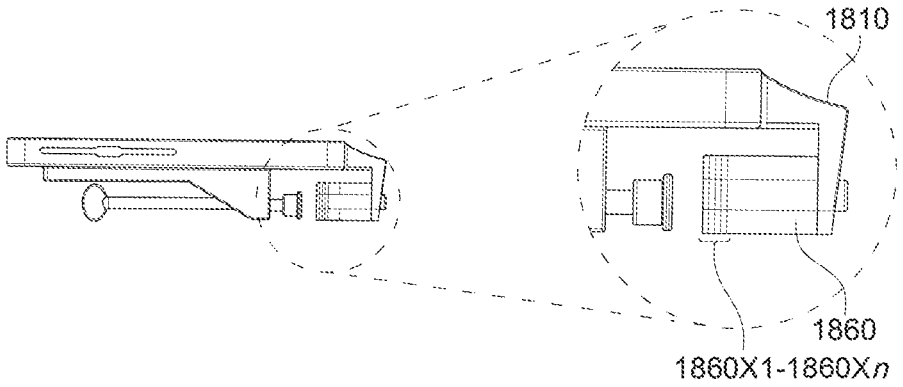
Figure 18E:
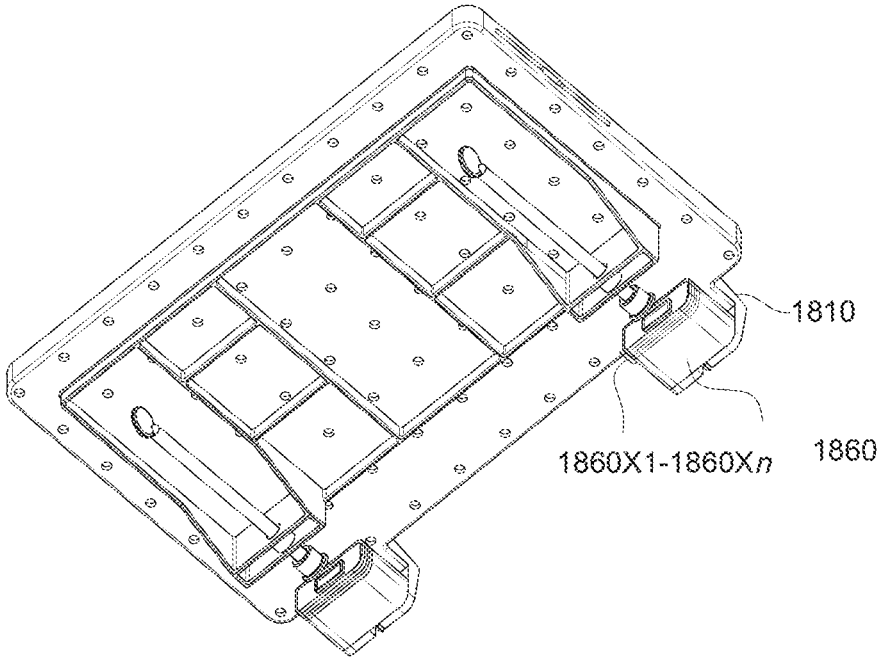
Figure 18F:
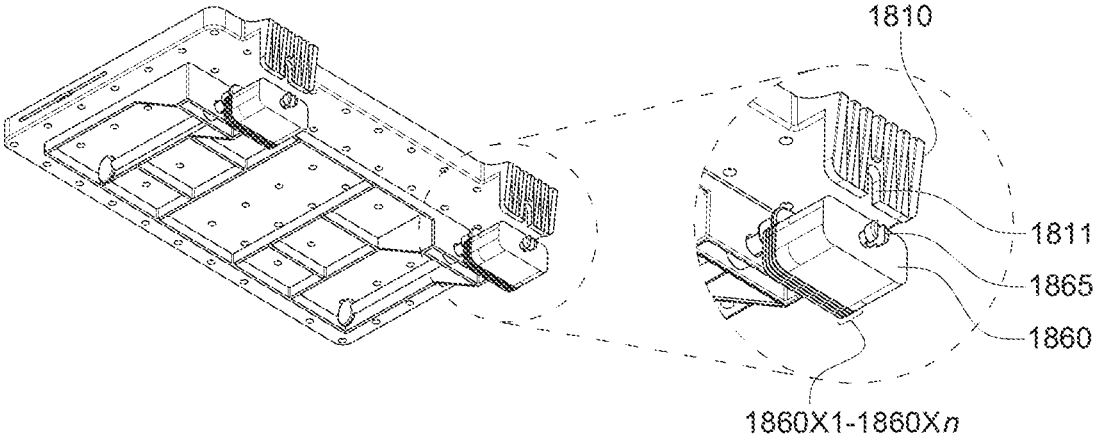
Figure 18G:
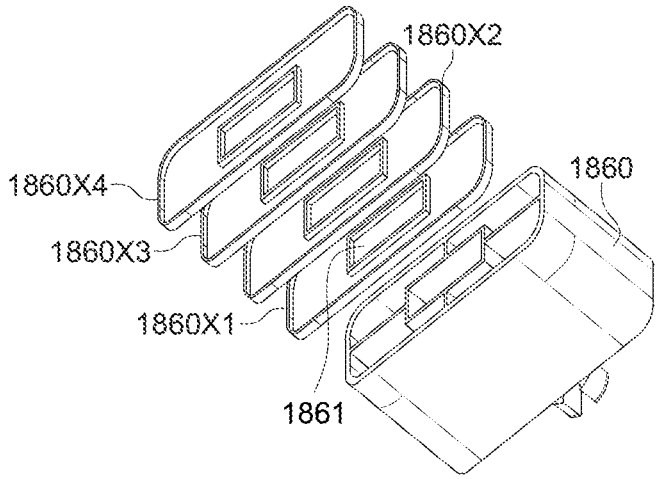
Figure 18H:
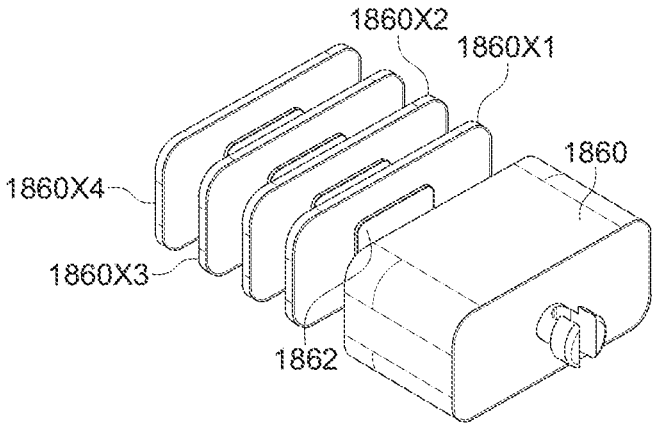
Figure 18I:
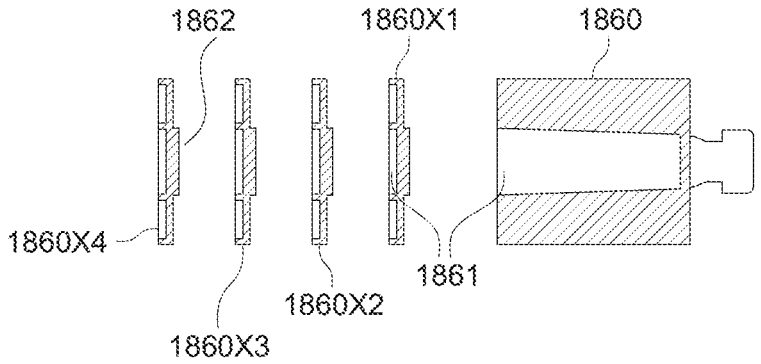

With reference to FIGS. 17H and 18A-18I, it is contemplated that in some situations support structure 1740 may be a right-angle support structure that has a horizontally oriented side 1741 and a vertically oriented side 1742 that extends downward from the horizontally oriented side 1741. In such a situation, a right-angle bracket 1810 of tray 100 comprises a protruding member in the form of block 1860 coupled to and extending from vertically oriented side 1825 of right-angle bracket 1810 of tray 100 in a substantially horizontal direction under at least a portion of the horizontally oriented side 1741 of right-angle support structure 1740. The coupling, for example, is accomplished with a peg 1865 on block 1860 inserted through a hole or slot 1811 as illustrated in FIG. 18F. Once the tray with right-angle bracket 1810 is positioned on support structure 1740, the top surface of block 1860 is positioned underneath the bottom surface of horizontally oriented side 1741 of right-angle support structure 1740 such that when downward or upward pressure is applied to tray 100, the block 1860 contacts the bottom surface of horizontally oriented side 1741 of right-angle support structure 1740 and prevents right-angle bracket 1810 from rotating about or slipping on right-angle support structure 1740, thereby preventing tray 100 from declining or inclining from its substantially horizontal orientation when downward or upward force is applied to tray 100. Additionally, one or more horizontally extending members 1860X1-1860Xn may be snapped into place to horizontally lengthen the block 1860 so that the block contacts vertically oriented side 1742 of right-angle support structure 1740 when the tray is positioned on support structure 1740. For example, FIGS. 18G, 18H, and 18I illustrate four horizontally extending members 1860X1, 1860X2, 1860X3 and 1860X4 are snapped into place essentially to horizontally extend, or lengthen, block 1860 such that the block contacts vertically oriented side 1742 of right-angle support structure 1740 when the tray is positioned on support structure 1740. As illustrated in FIGS. 18G, 18H, and 18I, the block 1860 and the horizontally extending members 1860X1-1860Xn each have a recessed or frame portion 1861. Each horizontally extending member 1860X1-1860Xn further includes a corresponding protruding portion 1862 that snaps into the recessed or framed portion of an adjacent block 1860 or other horizontally extending member 1860X1-1860Xn.

Figure 19A:
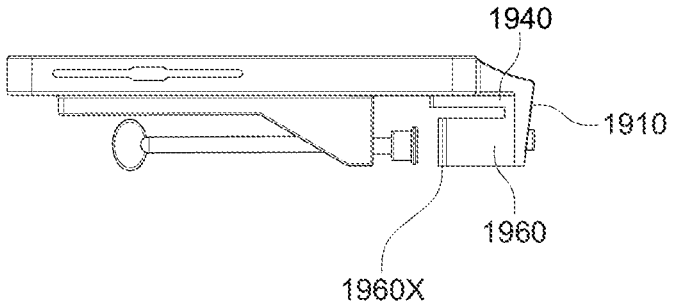
FIGS. 19A-19F illustrate aspects of a utility tray according to an embodiment of the invention.
Figure 19B:
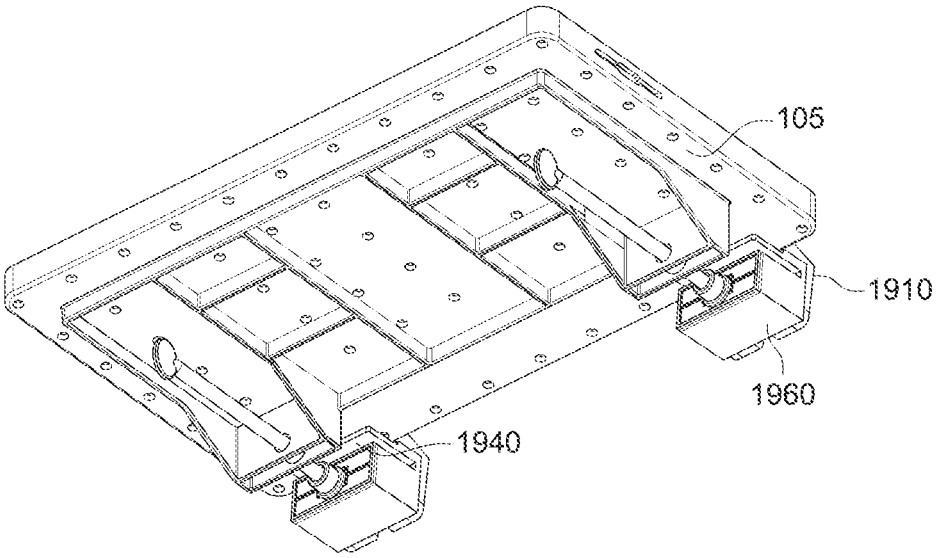
Figure 19C:
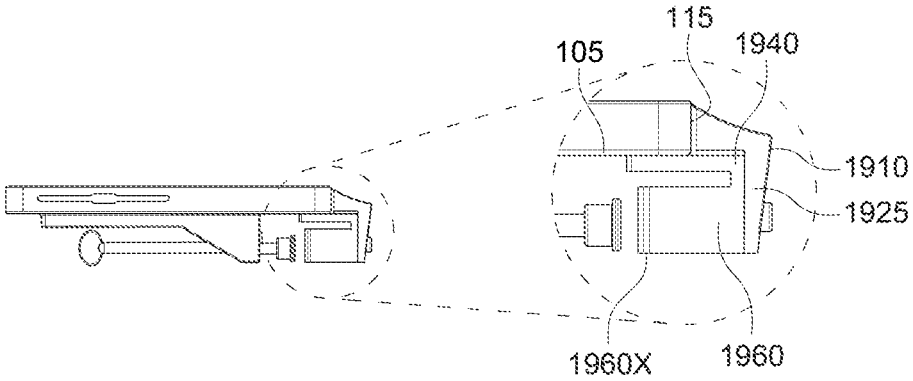
Figure 19D:
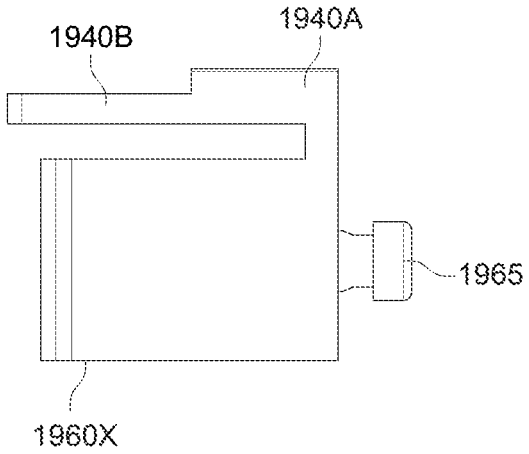
Figure 19E:
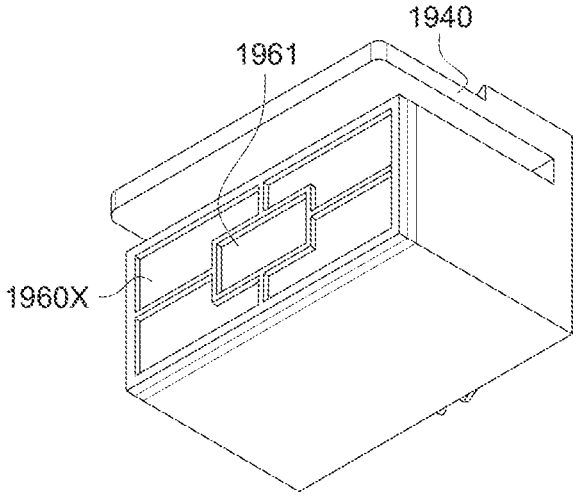
Figure 19F:
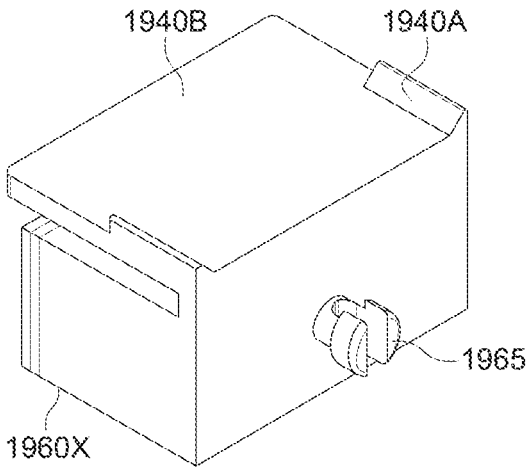
Figure 20A:
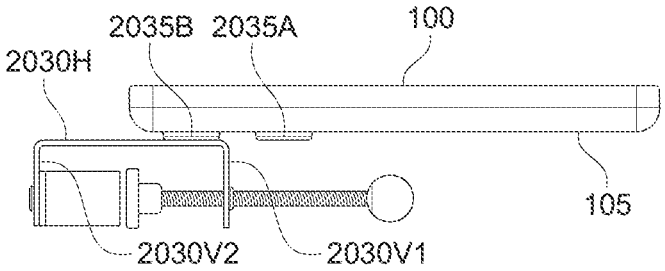
FIGS. 20A-20E illustrate aspects of a utility tray according to an embodiment of the invention.
Figure 20B:
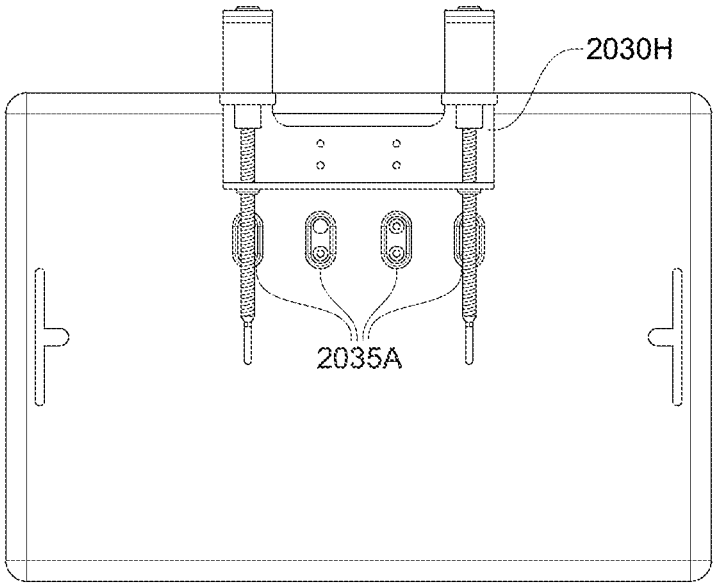
Figure 20C:
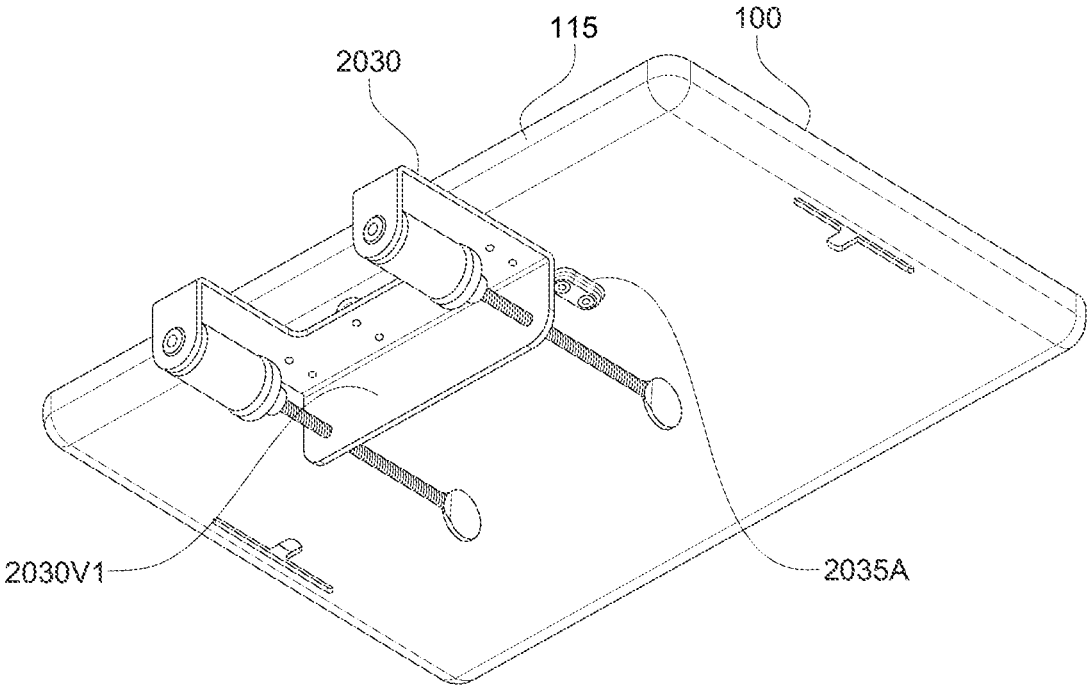
Figure 20D:
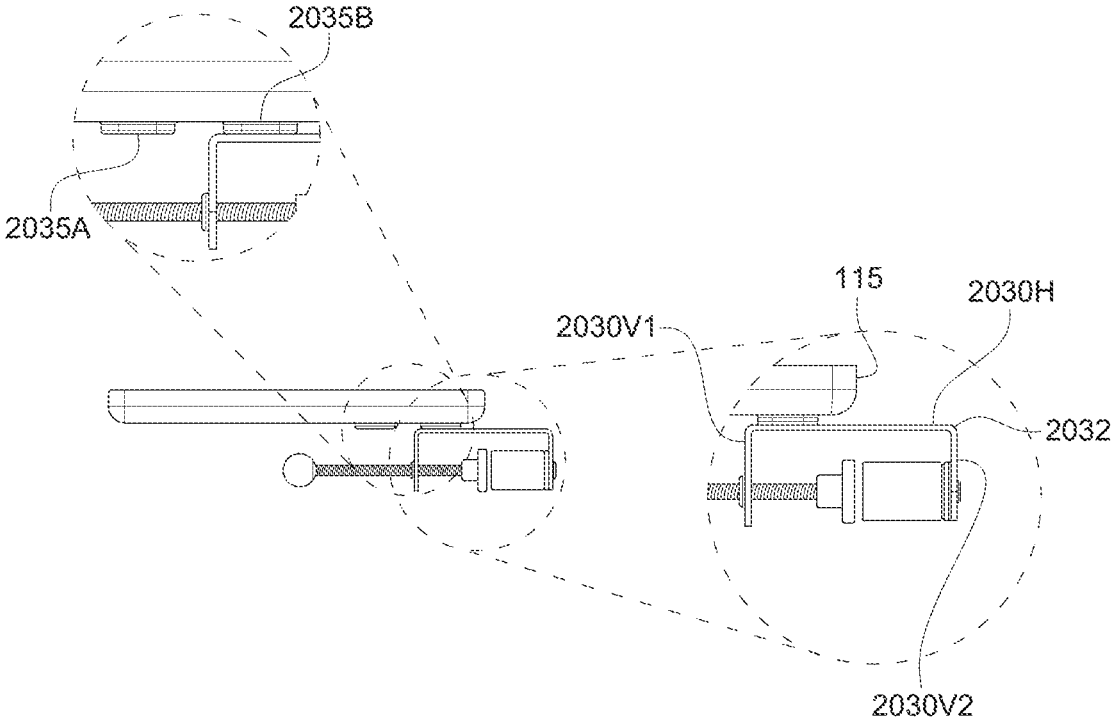
Figure 20E:
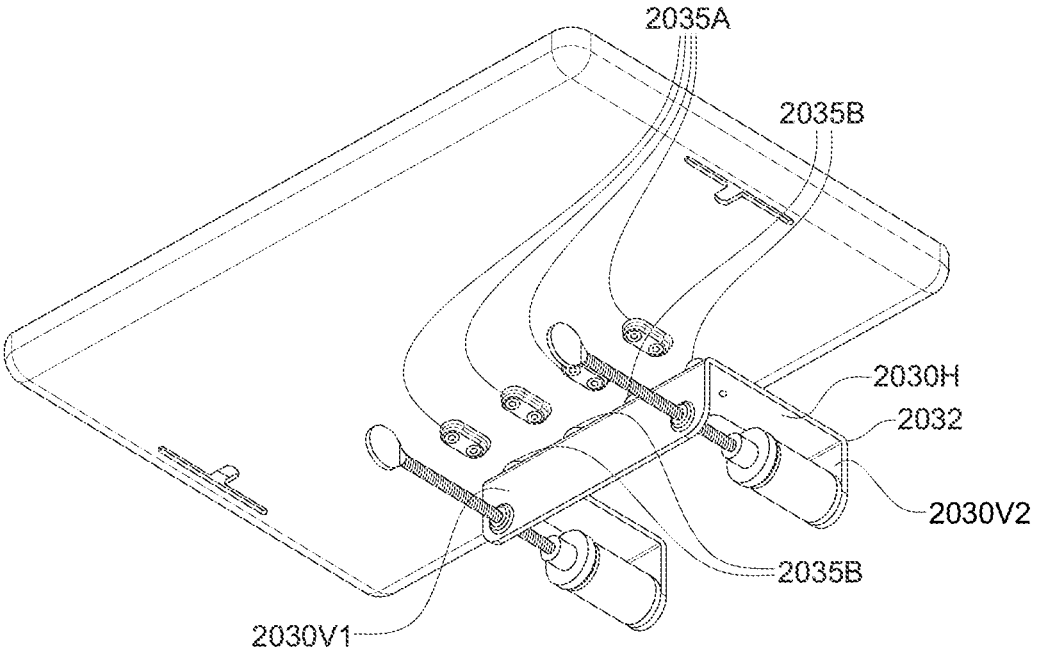

With reference to FIGS. 19A-19F, one embodiment combines one or more components from the embodiments described with respect to FIGS. 6A-6F, 7A-7F, 17A-17H and 18A-18I. In this embodiment, it is contemplated that support structure 1740 may be a right-angle support structure that has a horizontally oriented side 1741 and a vertically oriented side 1742 that extends downward from the horizontally oriented side 1741. In such a situation, a right-angle bracket 1910 of tray 100 comprises a protruding member in the form of block 1960 coupled to and extending from vertically oriented side 1925 of right-angle bracket 1910 of tray 100 in a substantially horizontal direction under at least a portion of the horizontally oriented side 1741 of right-angle support structure 1740. The coupling, for example, is accomplished with a peg 1965 as illustrated in FIGS. 19D and 19F on block 1960 inserted through a hole or slot of vertically oriented side 1925 of right-angle bracket 1910 of tray 100 (not shown). Once the tray with right-angle bracket 1910 is positioned on support structure 1740, the top surface of block 1960 is positioned underneath the bottom surface of horizontally oriented side 1741 of right-angle support structure 1740 such that when downward or upward pressure is applied to tray 100, the block 1960 contacts the bottom surface of horizontally oriented side 1741 of right-angle support structure 1740 and prevents right-angle bracket 1910 from rotating about or slipping on right-angle support structure 1740, thereby preventing tray 100 from declining or inclining from its substantially horizontal orientation when downward or upward force is applied to tray 100.

Additionally, one or more horizontally extending members 1960X1-1960Xn may be snapped into place to horizontally lengthen the block 1960 so that the block contacts vertically oriented side 1742 of right-angle support structure 1740 when the tray is positioned on support structure 1740. For example, FIGS. 19C-19F illustrate multiple horizontally extending members 1960X snapped into place essentially to horizontally extend, or lengthen, block 1960 such that the block contacts vertically oriented side 1742 of right-angle support structure 1740 when the tray is positioned on support structure 1740. Just like block 1860 and the horizontally extending members 1860X1-1860Xn described with reference to FIGS. 18A-18I, each horizontally extending member 1960X has a recessed or frame portion 1961. Each horizontally extending member 1960X further includes a corresponding protruding portion that snaps into the recessed or framed portion of an adjacent block 1960 or other horizontally extending member 1960X.

The embodiments illustrated in FIGS. 17A-17H, 18A-18I and 19A-19F contemplate use of a right-angle bracket. However, it is appreciated that these embodiments may be adapted to use a vertical bracket, such as described in the embodiment of the invention illustrated in FIGS. 6A-6F, which uses only a vertical bracket 610, that is, a bracket that extends downward in a vertical direction from edge 115 of tray 100. Additionally, component 1940 provides a vertical spacer to provide a similar function as the vertical spacers (640, 740) described with reference to FIGS. 6A-6F and 7A-7F. The vertical spacer 1940 is coupled to the block 1960 and abuts the bottom surface of base 105 next to edge 115 of the tray 100 to provide a vertical distance between the bottom surface of the base and a top surface of the support structure. Such spacing may be needed depending on other components coupled to the support structure. For example, as illustrated in FIGS. 4A and 4B, bed springs 436 are coupled at locations 437 to support structure 440 with sufficient horizontal clearance between the locations 437 and edge 115 of tray 100. However, if such horizontal clearance is not possible, then providing for vertical clearance with the use of vertical spacers such as spacer 1940 allows tray 100 to be firmly mounted to support structure 430 without contacting springs 436.

With reference to FIGS. 20A-20E, the tray 100 has one or more brackets 2030 with a horizontally oriented portion 2030H coupled to a bottom surface of the base 105 and a first vertically oriented portion 2030V1 extending downward in the direction substantially normal to the base. The bracket 2030 may be mounted to the bottom surface of base 105 at different locations. For example, as illustrated FIGS. 20A-20E, a bracket 2030 may be mounted along a line comprising a plurality of mounting locations 2035A, or along a line comprising a second plurality of mounting locations 2035B. Additionally, according to an embodiment, bracket 2030 can include a second vertically oriented portion 2030V2 that functions in the same manner as, for example, bracket 110 illustrated, for example, in FIGS. 1A-1F, so that a single component 2030 comprising two brackets 2030V1 and 2030V2 can be mounted at different locations at the bottom surface of base 105 with sufficient horizontal distance between the brackets 2030V1 and 2030V2 to receive a support structure, such as support structure 340 or 440 illustrated in FIGS. 3B and 4B. In this embodiment, for example, it is possible to couple component 2030 to the line of mounts illustrated at 2035A, in which case bracket 2030V2 extends downward in a vertical direction from edge 115 of tray 100. Alternatively, it is possible to couple component 2030 to the line of mounts illustrated at 2035B, in which case the vertical bracket 2030V2 is offset from edge 115 of tray 100 where it extends downward in a vertical direction, in the same manner as illustrated with the right-angle bracket 110 illustrated in FIGS. 1A-1F, where the vertical portion 125 of right-angle bracket 110 extends downward in a vertical direction. The horizontally oriented portion 2030H extends in a direction parallel to a plane of the base, and then vertically oriented bracket 2030V2 extends from the horizontally oriented portion at a common corner 2032 and extends downward.

Although the invention has been described and illustrated in the foregoing illustrative embodiments, it is understood that the present disclosure has been made only by way of example, and that numerous changes in the details of implementation of the invention can be made without departing from the spirit and scope of the invention, which is only limited by the claims that follow. Features of the disclosed embodiments can be combined and rearranged in various ways.

What is claimed is:

1. A tray, capable of being frictionally engaged to a support structure, the tray comprising:

a planar base extending in a horizontal plane and having an edge;

a right-angle bracket having a horizontally oriented side, an edge of which is coupled to the edge of the base, the horizontally oriented side extending further in the horizontal plane from the edge of the base, the right-angle bracket having a vertically oriented side coupled to the horizontally oriented side at a corner of the right-angle bracket and extending downward;

a bracket, having a threaded hole, coupled to a bottom surface of the base and extending downward in the direction substantially normal to the base, the bracket positioned a horizontal distance from the edge of the base and opposite the right-angle bracket sufficient to receive the support structure positioned therebetween; and a screw comprising a handle at a first end of the screw and a shoe at a second end of the screw, the second end of the screw passing through the threaded hole of the bracket and extending toward the right-angle bracket, wherein movement of the handle causes the second end of the screw to further extend horizontally toward the right-angle bracket such that: the shoe is substantially in vertical alignment with the edge of the base, and the shoe and the right-angle bracket frictionally engage the support structure positioned therebetween.

2. The tray of claim 1, wherein the planar base comprises a peg board, the tray further comprising: a peg board accessory coupled to the peg board, the peg board accessory selected from a group of peg board accessories consisting of: a support post, a J-style hook, an S-style hook, a loop, a bungee, a mobile computing device holder, a mobile phone holder, a dividing wall, a side wall, a cup holder, an LED light, a fan, a USB charging port, a DC electrical outlet, an electrical surge protector, a DC power strip, and a USB charging port device; each accessory comprising at least one pin by which the accessory engages a hole in the peg board to couple the accessory to the peg board.

3. The tray of claim 1, wherein the right-angle bracket comprises a ribbed surface.

4. The tray of claim 3, wherein the ribbed surface comprises:

a plurality of spaced apart horizontally oriented ribs attached to a top surface of the horizontally oriented side of the right-angle bracket and extending in a direction normal to the edge of the horizontally oriented side of the right-angle bracket; and a plurality of spaced apart vertically oriented ribs attached to an outside surface of the vertically oriented side of the right-angle bracket.

5. The tray of claim 1, further comprising a vertical spacer coupled to the bottom surface of the base proximate the edge of the base to provide a vertical distance between the bottom surface of the base and a top surface of the support structure.

6. The tray of claim 1, wherein the support structure, to which the tray is capable of being frictionally engaged, is a right-angle support structure that has a horizontally oriented side and a vertically oriented side that extends downward from the horizontally oriented side; and wherein the right-angle bracket of the tray comprises a protruding member coupled to and extending from the vertically oriented side of the right-angle bracket of the tray in a substantially horizontal direction under at least a portion of the horizontally oriented side of the right-angle support structure.

7. The tray of claim 6, wherein at least a portion of the protruding member coupled to and extending from the vertically oriented side of the right-angle bracket of the tray in the substantially horizontal direction under at least the portion of the horizontally oriented side of the right-angle support structure, to which the tray is capable of being frictionally engaged, abuts the portion of the horizontally oriented side of the right-angle support structure.

8. The tray of claim 1, wherein the support structure is a right-angle support structure that has a horizontally oriented side and a vertically oriented side that extends downward from the horizontally oriented side;

wherein the right-angle bracket of the tray comprises a threaded hole; and the tray further comprising a second screw comprising a handle at a first end of the second screw and a second shoe at a second end of the second screw, the second end of the second screw passing through the threaded hole of the right-angle bracket and extending toward the vertically oriented side of the right-angle support structure, wherein movement of the handle causes the second shoe to frictionally engage the vertically oriented side of the right-angle support structure.

9. The tray of claim 1, wherein the support structure is a right-angle support structure that has a horizontally oriented side and a vertically oriented side that extends downward from the horizontally oriented side;

wherein the right-angle bracket of the tray comprises a slot; and the tray further comprising a second screw comprising a handle at a first end of the second screw, a second shoe at a second end of the second screw, and a nut threaded onto the screw about its midsection, the nut situated in the slot of the right-angle bracket, the second screw extending toward the vertically oriented side of the right-angle support structure, wherein movement of the handle causes the second shoe to frictionally engage the vertically oriented side of the right-angle support structure.

10. The tray of claim 1, wherein the support structure is a right-angle support structure that has a horizontally oriented side and a vertically oriented side that extends downward from the horizontally oriented side; and wherein the right-angle bracket of the tray comprises a block extending from the vertically oriented side of the right-angle bracket of the tray in a substantially horizontal direction under at least a portion of the horizontally oriented side of the right-angle support structure.

* * * * *